US006132065A

United States Patent [19]

Wedell et al.

[11] Patent Number: 6,132,065

[45] Date of Patent: Oct. 17, 2000

[54] ROADWAY LUMINAIRE

[75] Inventors: Mark T. Wedell, Germantown, Tenn.; Timothy D. Cathey, Raleigh, N.C.; Margaret A. Self, Lake Cormorant, Miss.; John DeCandia; Greg Marik, both of Germantown, Tenn.; Thomas A. Zimmerman, Southaven, Miss.; Edward B. Bilson; R. W. Kauffman, both of Memphis, Tenn.

[73] Assignee: Thomas & Betts International, Inc., Sparks, Nev.

[21] Appl. No.: 09/247,802

[22] Filed: Feb. 8, 1999

Related U.S. Application Data

[60] Division of application No. 08/813,747, Mar. 7, 1997, Pat. No. 5,941,632, which is a continuation-in-part of application No. 08/610,575, Mar. 8, 1996, Pat. No. 5,803,590.

[51] Int. Cl.[7] ..... F21P 1/00; F21V 31/02

[52] U.S. Cl. ..... 362/267; 362/310; 362/431; 362/375; 362/370; 362/346

[58] Field of Search ..... 362/341, 516, 362/343, 347, 350, 297, 346, 267, 310, 374, 375, 410, 431

[56] References Cited

U.S. PATENT DOCUMENTS

| | | | |
|---|---|---|---|
| 3,018,081 | 1/1962 | Waldbauer . | |
| 3,023,394 | 2/1962 | Hubbell . | |
| 3,071,683 | 1/1963 | Queale . | |
| 3,094,220 | 6/1963 | Harling . | |
| 3,120,985 | 2/1964 | Hubbell . | |
| 3,142,501 | 7/1964 | Clark et al. . | |
| 3,146,054 | 8/1964 | Shearer et al. . | |
| 3,177,462 | 4/1965 | Sarnmark . | |
| 3,184,199 | 5/1965 | Clark et al. . | |
| 3,297,864 | 1/1967 | Waldbauer . | |
| 3,387,866 | 6/1968 | Baldwin . | |
| 3,432,629 | 3/1969 | Field et al. . | |
| 3,530,287 | 9/1970 | Husby . | |
| 3,562,509 | 2/1971 | Kahl, Jr. . | |
| 3,614,711 | 10/1971 | Anderson et al. . | |
| 4,152,757 | 5/1979 | Bilson et al. . | |
| 4,167,033 | 9/1979 | Fletcher . | |
| 4,200,901 | 4/1980 | Shaffer et al. | 362/5 |
| 4,229,064 | 10/1980 | Vetter et al. . | |
| 4,345,306 | 8/1982 | Summey . | |
| 4,360,863 | 11/1982 | Barnes et al. . | |
| 4,379,321 | 4/1983 | Plemmons et al. . | |
| 4,384,316 | 5/1983 | de Vos et al. . | |
| 4,388,680 | 6/1983 | Moore . | |
| 4,392,192 | 7/1983 | Steadman . | |
| 4,426,676 | 1/1984 | Taylor | 362/431 |
| 4,433,367 | 2/1984 | Shelby et al. . | |
| 4,449,168 | 5/1984 | Ewing . | |
| 4,473,873 | 9/1984 | Quiogue . | |
| 4,500,946 | 2/1985 | Mikola . | |
| 4,538,217 | 8/1985 | Ewing et al. . | |
| 4,551,793 | 11/1985 | Mellema . | |
| 4,559,587 | 12/1985 | Quiogue et al. | 362/147 |
| 4,617,619 | 10/1986 | Gehly | 362/804 |
| 4,639,843 | 1/1987 | Compton . | |
| 4,736,999 | 4/1988 | Marks et al. . | |

(List continued on next page.)

FOREIGN PATENT DOCUMENTS

| | | |
|---|---|---|
| 1 142 963 | 1/1963 | Germany . |
| 973 165 | 10/1964 | Switzerland . |

*Primary Examiner*—Thomas M. Sember
*Attorney, Agent, or Firm*—Hoffmann & Baron, LLP

[57] ABSTRACT

A method of manufacturing a roadway luminaire is provided which includes the steps of molding an upper housing from a composite material and applying a reflective substance directly to an inner surface of a domed portion of the housing to create a reflector. The luminaire further includes a lower housing hingedly attached to the upper housing which supports a lens therein and is pivotable into an open position and latched to the upper housing in a closed position. Means are provided for mounting the luminaire to a pole.

6 Claims, 27 Drawing Sheets

U.S. PATENT DOCUMENTS

| | | | |
|---|---|---|---|
| 4,772,226 | 9/1988 | Schlesinger . | |
| 4,791,539 | 12/1988 | Ewing . | |
| 4,793,581 | 12/1988 | Bilson et al. | 362/431 |
| 4,796,001 | 1/1989 | Gostyla . | |
| 4,907,139 | 3/1990 | Quiogue . | |
| 4,937,718 | 6/1990 | Murray | 362/431 |
| 5,010,458 | 4/1991 | Fraizer | 362/341 |
| 5,134,554 | 7/1992 | Donato et al. . | |
| 5,136,493 | 8/1992 | Straus et al. . | |
| 5,243,508 | 9/1993 | Ewing et al. . | |
| 5,249,112 | 9/1993 | Bray . | |
| 5,266,738 | 11/1993 | MacVoy . | |
| 5,287,259 | 2/1994 | Lautzenheiser | 362/341 |
| 5,351,174 | 9/1994 | Ewing . | |
| 5,395,246 | 3/1995 | Punako et al. . | |
| 5,651,612 | 7/1997 | Braun | 362/431 |

ROADWAY LUMINAIRE

This is a divisional application of application Ser. No. 08/813,747, filed on Mar. 7, 1997, now U.S. Pat. No. 5,941,632 which is a continuation-in-part of application Ser. No. 08/610,575, filed on Mar. 8, 1996, now U.S. Pat. No. 5,803,590.

FIELD OF INVENTION

The present invention relates generally to luminaires for outdoor lighting and more particularly relates to a roadway luminaire which is easy to mount to a mast arm and easy to maintain due to a mounting arm assembly, a twist-lock feature, a fool-proof power plug and a plug-in replacement luminaire.

BACKGROUND OF THE INVENTION

Poles for supporting luminaires for the illumination of roadways, parking lots and the like differ not only in that they have either a vertical end with a mast arm or an inclined end, but also in that the diameters of the poles vary. For example, some poles have approximately a horizontal end, the end often being at an angle of 5° to about 15° to the horizontal. This variety of pole construction results in that luminaires are commonly manufactured and warehoused in a corresponding variety of constructions. Accordingly, it would be advantageous to have a universal mounting device for mounting a luminaire to a pole or mast arm.

Additionally, current maintenance costs associated with roadway luminaires is extremely high. Particularly, maintenance is usually performed by licensed electricians to replace capacitors, ballasts, photoelectric controls, starters and complete luminaires. The average cost to replace/install a luminaire is approximately three times the cost of the luminaire itself, e.g. the cost of three men, two trucks and a trailer. There have been efforts in the past to overcome some of the maintenance problems associated with roadway illumination. For example, U.S. Pat. No. 4,937,718 discloses a roadway luminaire having the electrical components employed in the lamp ballasting circuitry mounted to a door member by means of a universal mounting bracket having a deformable planer construction. In this way, a variety of different sized components can be mounted using the disclosed bracket. Additionally, U.S. Pat. No. 4,538,217 discloses a flood light luminaire having all the electrical components mounted on a removable door casting to allow for servicing and maintenance. U.S. Pat. No. 4,791,539 discloses a luminaire having quick-disconnect components which are mounted on an electrical plate detachably secured to a support plate of the luminaire. The plate includes a quick disconnect for detaching the electrical plate from the support plate. However, maintenance of the luminaire is still costly and replacement of components of the ballasting circuitry is difficult and time consuming.

Another disadvantage of known roadway luminaires includes the possibility of replacing a luminaire with one of a different voltage. Currently, roadway lighting may be operated at voltages of 120, 208, 220, 230, 240, 277, 347 and 480 volts throughout the world. Accordingly, it is quite possible when replacing or repairing luminaires to use replacement parts rated for a different voltage. Thus, it would be advantageous to provide a luminaire which includes a means for keying the luminaire so that it can only be replaced by a luminaire which operates at the same voltage.

Yet another disadvantage of known roadway luminaires is the "hot wiring" of the luminaire, thus making replacement difficult and dangerous. In most cases, rather than shutting off the power to the roadway lighting, the lighting is repaired with power being supplied to the luminaire. Accordingly, only licensed electricians with proper protective gear generally perform replacements of luminaires. Thus it would be advantageous to have a luminaire which can be safely and easily replaced even with power being supplied to the luminaire.

In view of the present disadvantages of currently available roadway lighting devices, it is desirable to redesign the luminaire to be easy to install and maintain, provide a fool-proof replacement system which permits only luminaires of same voltage to replace a damaged luminaire and to make installation and maintenance more cost effective.

SUMMARY OF THE INVENTION

It is an object of the present invention to allow safe and easy installation and maintenance of roadway luminaires.

It is a further object of the present invention to provide an improved mounting system for a luminaire to a mast arm.

It is yet a further object of the present invention to provide a keyed power plug receptacle for connecting the luminaire to the power supply.

It is yet another object of the present invention to provide a luminaire which can be mounted to a mast arm assembly utilizing a simple twist-lock feature.

It is still a further object of the present invention to provide a luminaire having a plug-in starter module located externally on the luminaire housing for ease of replacement.

It is yet a further object of the present invention to provide a luminaire including an internal leveling device for proper positioning of the luminaire.

In accordance with the present invention, a luminaire for mounting on a pole, and more specifically, a roadway luminaire includes a mast mount docking station. having a clamp for attaching to the pole at one end of the docking station and a keyed coupling means provided at an opposite end of the docking station and the luminaire having a connecting plate provided with keyways such that the luminaire is removably coupled to the mast mount docking station by a twist-lock mating between the keys and keyways of the coupling means and connector plate. The mast mount docking station further includes an electrical plug connector located at the coupling end of the docking station and, the luminaire includes a mating electrical plug connector for electrically connecting the mast mount docking station to the luminaire. Specifically, the supply voltage is coupled to the electrical plug connector in the mast mount docking station and the mating electrical plug connector in the luminaire provides the supply voltage to the ballast circuitry and ultimately the lamp.

For ease of attachment of the mast mount docking station to the pole, the docking station includes a plurality of knock-outs for adapting to mast diameters of varying sizes. In this way, the mast mount docking station can be specifically adapted such that little space is left between the mast and the docking station to prevent animals and the like from entering the docking station. The docking station more specifically includes an upper mast assembly and a lower mast assembly. The upper mast assembly includes the clamp for attaching the docking station to the pole. The upper and lower mast assemblies are secured together by bolts such that the electrical plug connector mentioned above is secured therebetween. Additionally, the docking station may include a series of inclined steps located in the upper mast assembly to permit angles of tilt for leveling the luminaire.

With respect to the twist-lock feature, the luminaire may be coupled to the mast mount docking station by a 15° to about 30° rotational movement of the luminaire with respect to the docking station. This rotational movement provides both electrical and mechanical connection More specifically, upon rotation, the power plugs of the mast mount docking station and luminaire, respectively, are electrically connected and the keys of the docking station are mechanically connected to the connector plate of the luminaire in the same motion. The luminaire also preferably includes a molded photoelectric control receptacle extending above a top portion of the luminaire and a molded capacitor compartment which extends below a bottom portion of the luminaire to provide hand holds for performing the twist-lock mounting of the luminaire to the docking station With respect to the electrical connectors, each of the connectors is provided with a series of crenulations, each crenulation being identified with a specific voltage rating to cover the spectrum of all available international voltages. The twist-lock feature for mating the connectors is provided with keyways which ensure that only corresponding voltage rated connectors are operatively coupled together.

The roadway luminaire of the present invention also includes a lower housing in which the ballast circuitry is mounted to a surface thereof such that the starter receptacle opens externally to an assembled upper and lower housing assembly and the starter module includes a plug-in connector to electrically couple the starter to the receptacle without the use of tools. Likewise, the upper housing is provided with a photoelectric control cell receptacle integrally molded to a top surface thereof. The luminaire includes a plug-in photoelectric cell which can be selectively inserted into the receptacle and replaceable without the use of tools. Lastly, the lower housing includes a cavity for receiving a capacitor of the ballast circuitry. The capacitor is press-fit into the cavity for insertion and/or removal without the use of tools. Accordingly, maintenance of the luminaire is simple and fast.

Also disclosed is a method of installing or removing a roadway luminaire, the luminaire including a mast mount docking station for attachment to a pole mast. The luminaire and docking station having mating twist-lock connectors, the method comprising the step of twisting the luminaire with respect to the docking station to thereby mechanically couple and/or release the mating twist-lock connectors. The method is further defined such that the luminaire and mast mount docking station include mating power plug connectors and wherein the step of twisting the luminaire also electrically connects and/or disconnects the mating power plug connectors.

Additionally, a method of manufacturing a housing for a luminaire is disclosed. Specifically, the method includes the steps of molding a composite to form the housing including a dome section surrounding an area of the lamp; coating an inner surface of the dome section with urethane or enamel coating; vacuum metalizing the inner surface of the dome section with aluminum; and coating the inner surface of the dome section with acrylic or urethane to form a reflective surface.

The luminaire of the present invention also includes a mast mounting assembly including means for mounting the mast mounting assembly to a pole at one end of the assembly and a coupling means at the opposite end of the assembly. The luminaire Includes a housing for mounting a lamp, the housing including a mounting means for mechanically coupling the luminaire to the mast mounting assembly. Additionally, the mast mounting assembly coupling means and luminaire mounting means preferably include cooperating telescoping alignment means for ease of assembling the luminaire to the mast mounting assembly. More particularly, the cooperating telescoping alignment means may include an alignment flange on the luminaire and the mast mounting assembly may be dimensioned at its coupling means end to be slidingly fitted into the alignment flange of the luminaire.

Furthermore, the mast mounting assembly may include a first power plug electrically coupled to a supply voltage and the luminaire may include a second power plug electrically coupled to a lamp socket. The cooperating telescoping alignment means may include the first and second power plugs having cooperating telescoping portions for aligning the mast mounting assembly and luminaire upon mechanically mating together.

The combination luminaire and mast mounting assembly may also include cooperating interlockig engagement means to positively latch the luminaire to the mast mounting assembly upon mechanically coupling two components. The cooperating interlocking engagement means may include a spring latch mounted on the mast mounting assembly and a cammed receiving slot on the luminaire whereby upon twist-locking the cooperative mounting means on said luminaire and mast mounting assembly, the spring latch follows the cammed receiving slot into a locking recess thereby positively latching the luminaire and mast mounting assembly. Furthermore, the cammed receiving slot preferably includes a ledge portion whereby moving the spring latch onto the ledge portion disengages the cooperating interlocking engagement means so that the luminaire may be removed from the mast mounting assembly. Preferably, upon disassembling the luminaire from the mast mounting assembly, the spring latch automatically resets to a proper installation position.

The combination mast mounting assembly and luminaire of the present invention including cooperative engagement means for mechanically coupling the luminaire to the mast mounting assembly may further include a seal therebetween. More specifically, the luminaire preferably includes a flange having upstanding walls for receiving the seal. The seal includes a cross-section such that a rear portion is substantially square and a front portion is substantially frusto-conically shaped. The square cross-section portion is received in the walls of the flange and the frusto-conical shaped portion is compressed upon mechanically coupling the luminaire to the mast mounting assembly. The seal further includes at least one projection thereon for providing an interference fit relationship with the upstanding walls of the flange. Accordingly, the seal is easily positioned within the flange and can be easily removed for replacement by a new seal when necessary due to maintenance.

The roadway luminaire of the present invention is also disclosed as including an upper housing including a reflector and a lamp socket and a lower housing including a lens. The lower housing includes a recessed area therein for mounting a ballast to a pair of threaded bosses extending from a lower surface of the lower housing. The recessed area provides air flow completely around the ballast for cooling the ballast so that the ballast may operate at a lower temperature prolonging a useful life thereof. Additionally, the lower housing acts directly as a heat sink for heat generated within the enclosure formed between the upper and lower housings. Specifically, wind and ambient air temperature helps to directly cool the upper and lower housings of the luminaire.

Also disclosed is a method of manufacturing a roadway luminaire comprising the steps of molding an upper housing from a composite material, the upper housing including a dome portion such that an inner surface of the dome portion is molded having a reflector geometry, and applying a reflective substance directly to said inner surface of said dome portion to create the reflector. The step of applying a reflective substance may further include the step of using a vacuum metalization process to apply the reflective substance. The step of molding the upper housing may include the step of molding first and second upper housing sections, the first section including the dome portion, and following the applying step, further includes the step of mechanically coupling the first and second upper housing sections. Accordingly, only the first upper housing section including the dome portion is provided to the manufacturing process including applying the reflective substance to the housing. Reducing the size of the component part to enter the manufacturing process allows more component parts to be processed and, accordingly, reduces the manufacturing cost associated with the process of applying the reflective substance to the housing. The first and second sections of the upper housing may be joined using a lap joint and a series of threaded screws.

Also disclosed in the present invention is a reflector for use in the luminaire which includes a plurality of aiming bands arranged within the reflector. Each aiming band is angularly displaced along its surface in both a horizontal and vertical axis with respect to the reflector. Furthermore, each of the successive aiming bands of the reflector are vertically stacked to form the reflector. Preferably, the reflector is formed directly on an inner surface of a dome portion of the luminaire. The reflector also includes six reflective sections including a house side section, a street side section, a right and left side section, and a top right and top left side reflector section. The reflective surface is most efficiently applied to the upper housing using a vacuum metalization process.

The luminaire of the present invention may also include an upper housing and a lower housing which may be coupled to form the luminaire. The upper housing includes a reflector and a flange substantially surrounding the reflector. The flange may further include an upstanding wall substantially circumscribing a central section of the flange. The lower housing includes a lens in substantial alignment with the reflector of the upper housing. The lower housing also includes a gasket substantially surrounding the lens such that upon coupling the lower housing to the upper housing, the gasket is received in the upper housing flange and said upstanding wall engages the gasket thereby forming an effective seal therebetween. The upper housing may also include a photoelectric control cell receptacle integrally molded in a top surface of the housing for selective mounting therein of a plug-in photoelectric control cell without the use of tools.

The present invention is also directed to a method of mounting a lens in a luminaire comprising the steps of providing a housing including an opening therethrough and a rim around said opening providing an edge portion for supporting a lens thereon, and adhering a gasket to the housing and lens such that an edge portion of the lens and the edge portion of the housing are trapped beneath the gasket thereby holding the lens to the housing.

A preferred form of the luminaire, as well as other embodiments, objects, features and advantages of this invention, will be apparent from the following detailed description of illustrative embodiments thereof which is to be read in connection with the accompanying drawings.

DETAILED DESCRIPTION OF THE PREFERRED EMBODIMENTS

Figure 1:
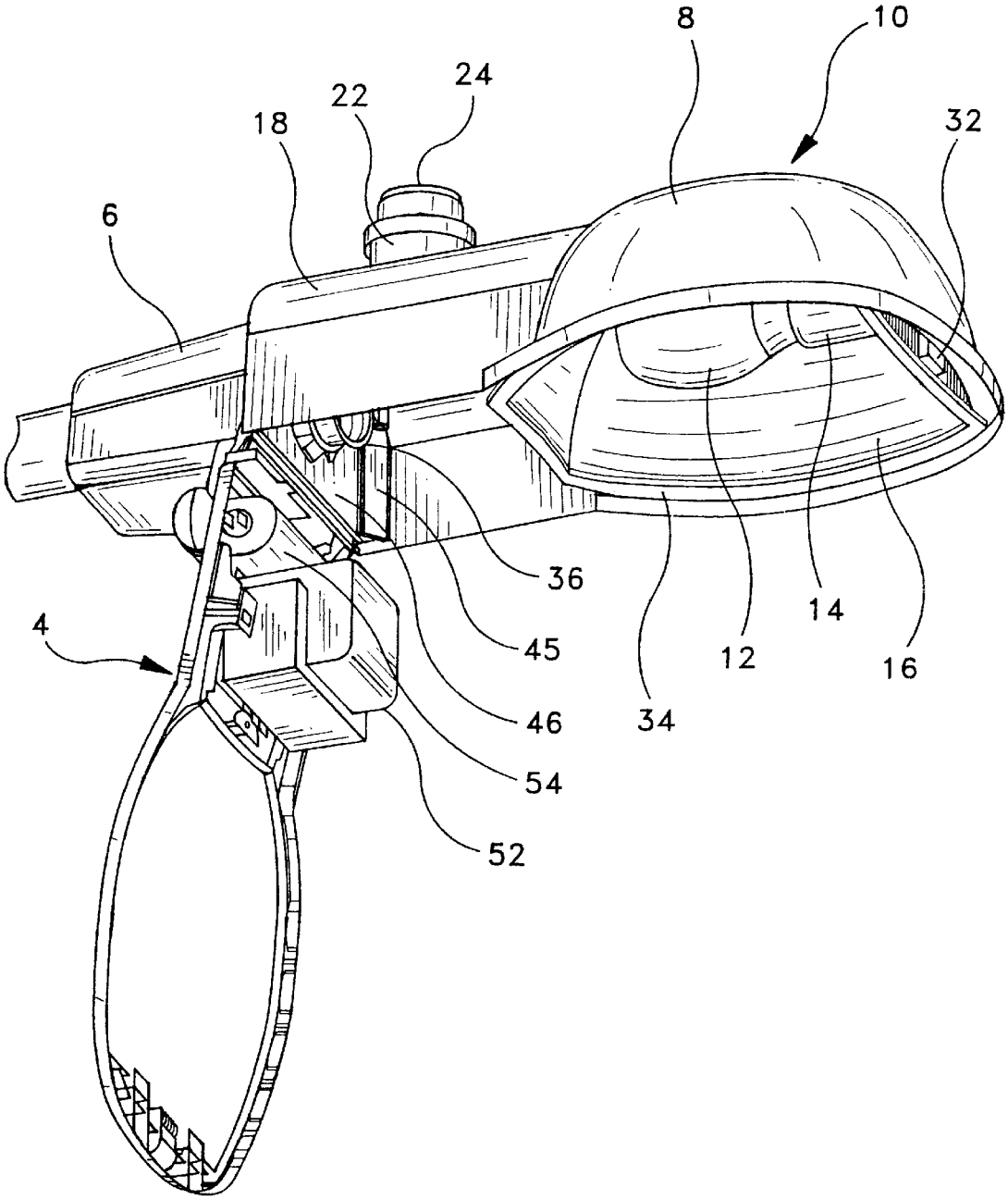
FIG. 1 is a perspective view of the luminaire assembly including the mast mounting assembly with the lower door of the luminaire in an open position formed in accordance with the present invention

FIG. 1 illustrates a roadway illumination luminaire 10 which includes an upper housing 2, a lower housing 4 and a mast mounting docking station 6. The upper housing 2 includes two sections. The first section is the dome section 8 which includes a lamp 12, lamp socket 14 and a reflective inner surface 16. The second section is the protective housing 18 for the electronic circuitry and electrical components of the luminaire.

Figure 8:
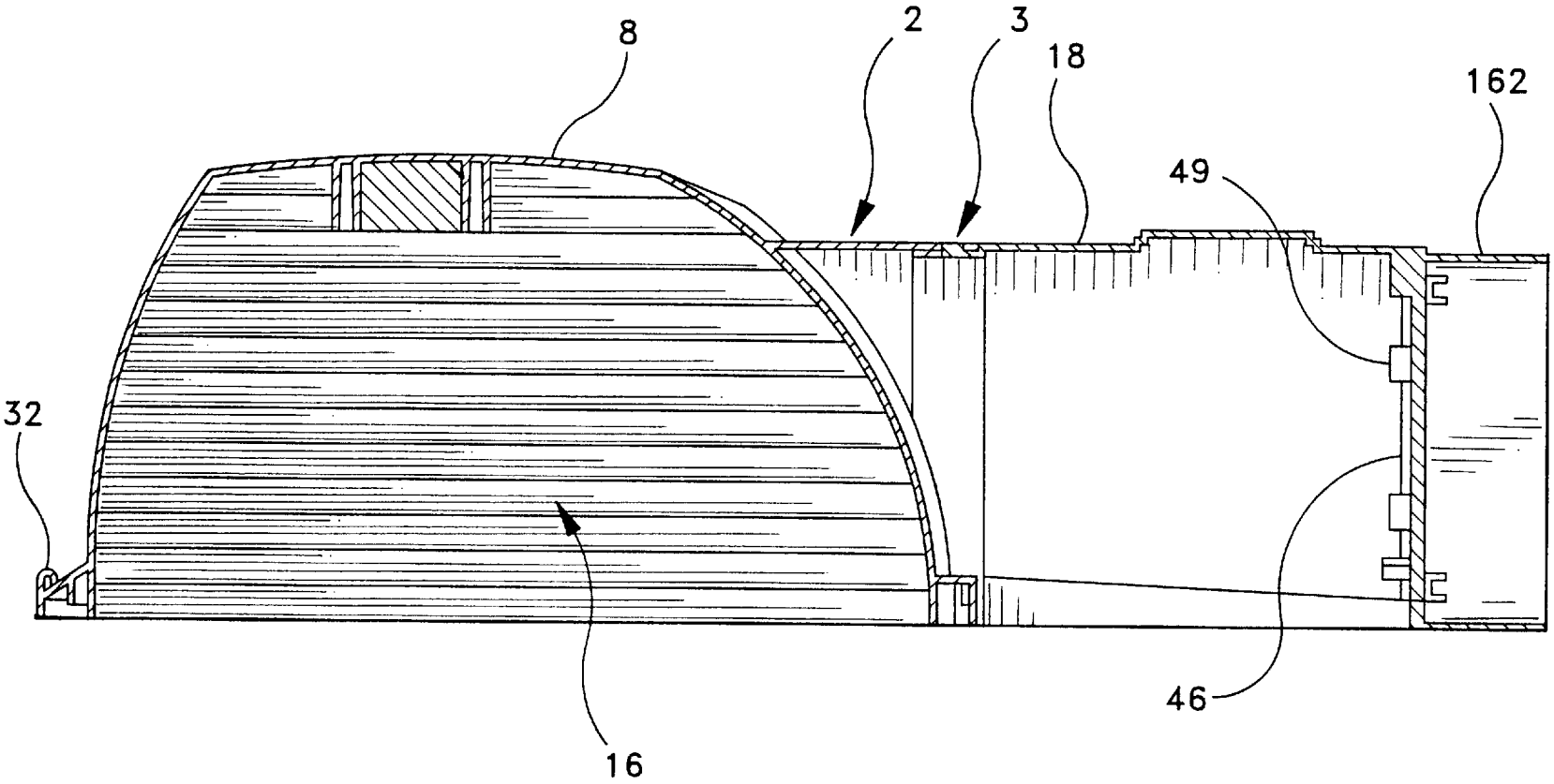
FIG. 8 is a longitudinal cross-sectional view of the upper housing.
Figure 10:
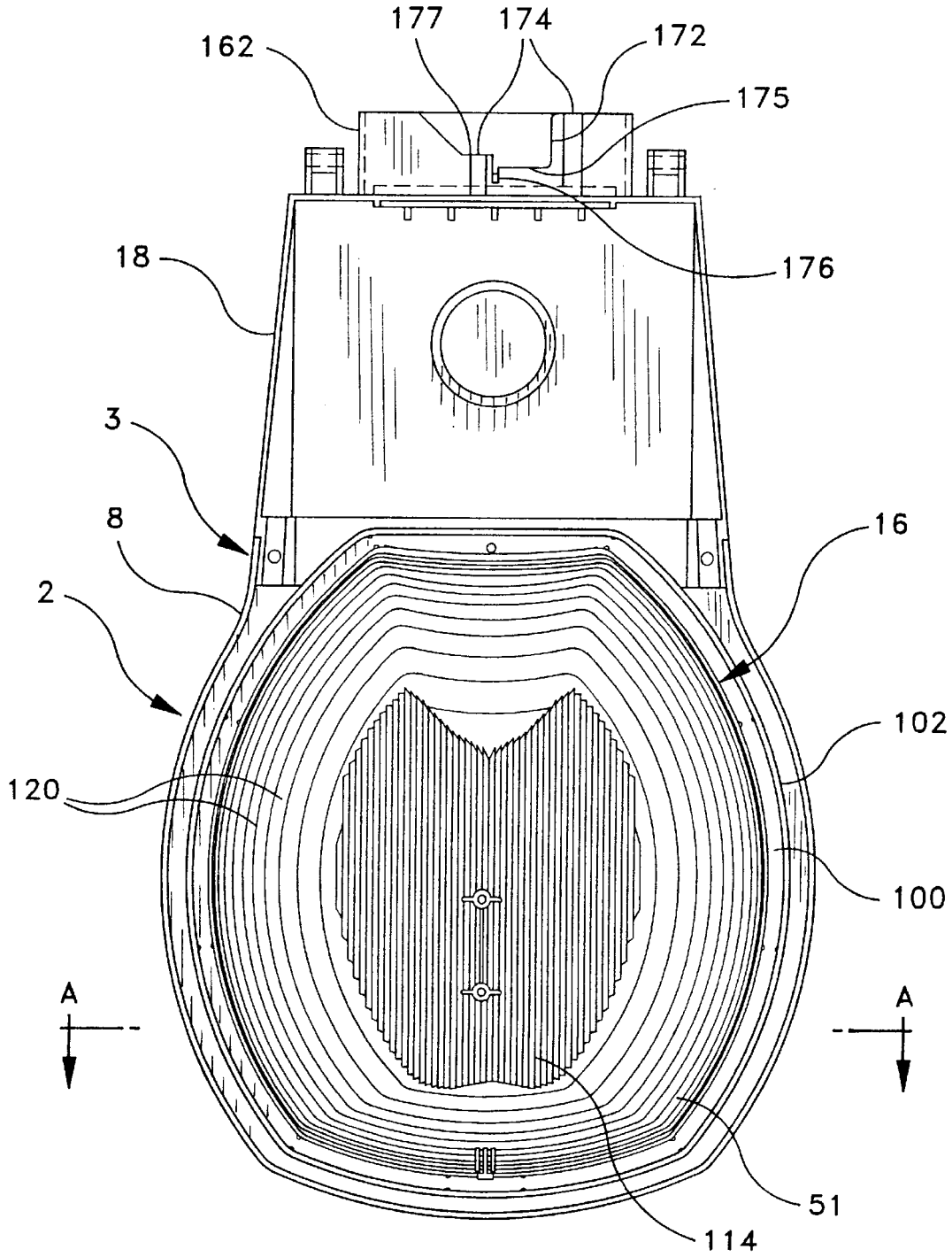
FIG. 10 is a bottom view of the upper housing illustrating the geometry of the reflective surface.

As illustrated in FIGS. 8 and 10, dome section 8 is formed separately from the protective housing 18 and joined together using a lap joint construction 3. This two-piece construction facilitates greater utilization of the metallizing process used to form the reflective inner surface 16. More specifically, the smaller the component part placed into the metalization machinery, the greater the capacity for the metallizing process thus reducing manufacturing costs. Since the protective housing 18 does not require the metallizing process, it may be formed separately from the dome section 8. To assist in alignment of the dome section 8 and protective housing 18, the protective housing includes at least one peg which is received in mating holes or recesses formed in the dome section 8. Furthermore, the two sections are bonded along the lap-joint and joined by screws to mechanically mate the sections.

Preferably, the upper housing 2 is formed of a long-life, weather and corrosion resistant fiber reinforced polymer construction. Known luminaires usually include separate reflectors that are typically stamped of aluminum and are supported in the dome portion of the luminaire housing. In the present invention, the reflector 16 is integrated into the upper housing 2. More specifically, the upper housing is preferably a compression molded composite with the reflective surface geometry 51 being formed during the molding process.

The preferred embodiments of the upper housing 2 and reflective surface include either a natural housing finish or a simulated metal finish. In a preferred embodiment of the upper housing 2, the interior reflective surface 16 is formed directly on the molded housing by applying base coating with a urethane or enamel coating, then vacuum metalized with aluminum and top coated with an acrylic or urethane. Thus, a reflective surface is provided directly on the interior of the dome portion only and all other surfaces are unfinished. Furthermore, the upper housing 2 may be pigmented grey during the molding process to achieve the simulated metal finish discussed above.

The upper housing 2 also includes a photoelectric control cell socket for receiving a plug-in photoelectric controller 24. The photoelectric control cell socket 22 is integrally formed during the molding process in a top section of the upper housing to provide for an unobstructed line-of-sight for the photoelectric control cell 24. The socket is preferably a standard three terminal, polarized, locking-type socket.

As shown in FIG. 1, the luminaire also includes a lower housing or door assembly 4 which is removably coupled the upper housing 2 via hooks 26 (FIG. 2) and detents 28 of the lower housing 4 which allows the lower housing or door to swing open exposing the inner portion of the upper housing and an inner surface of the lower housing. The lower housing 4 includes mounted thereon the ballast circuitry to electrically power the luminaire. The lower housing is capable of swinging to a closed position enclosing the luminaire and is held closed via a latch 32. Preferably, the latch 32 can be released without the use of tools to open the luminaire for repair and maintenance.

Also shown in FIG. 1 is a lock-plate 46 which is fitted into the upper housing at its mounting end. More specifically, in a first embodiment, the lock-plate 46 is held by a pair of triangular-shaped bosses 45 attached to the side walls of the upper housing to provide a slot between the bosses 45 and a rear wall 47 of the upper housing 2. The lock-plate 46 is then slidingly fitted in the receiving slot of the upper housing. The lock-plate 46 includes a central opening and a series of keyways 43 associated with the central opening for receiving the keys of mast mount docking station therein. The interrelationship of the lock-plate 46 with the mast mount docking station 6 will be described later in greater detail.

Figure 2:
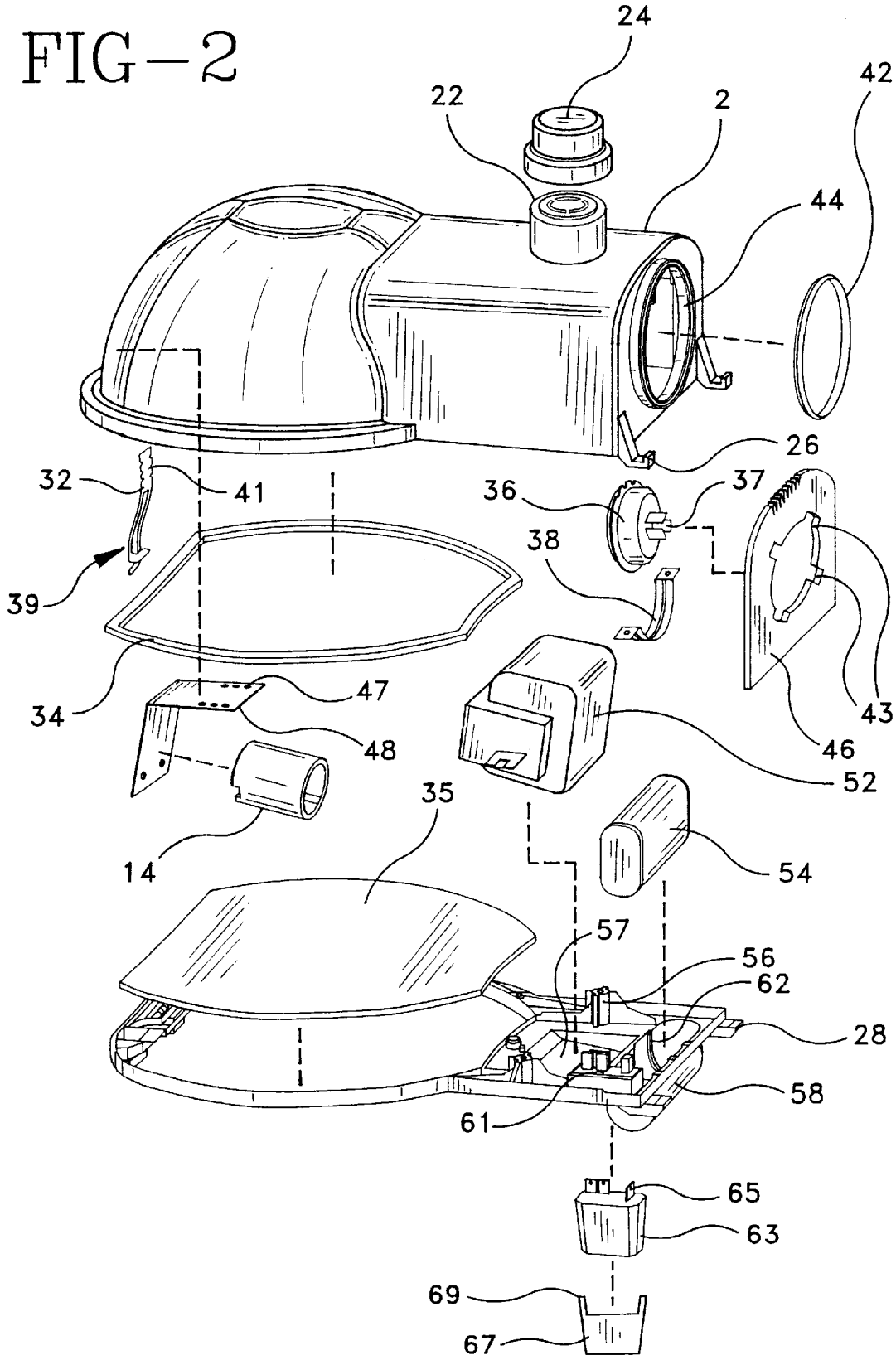
FIG. 2 is an exploded perspective view of the luminaire assembly formed in accordance with the present invention.
Figure 6A:
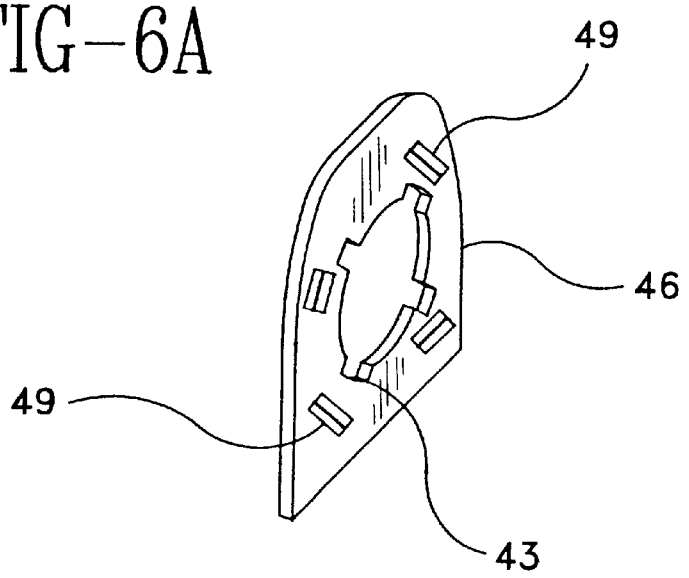
FIG. 6A is a perspective view of an alternative lock-plate.
Figure 6B:
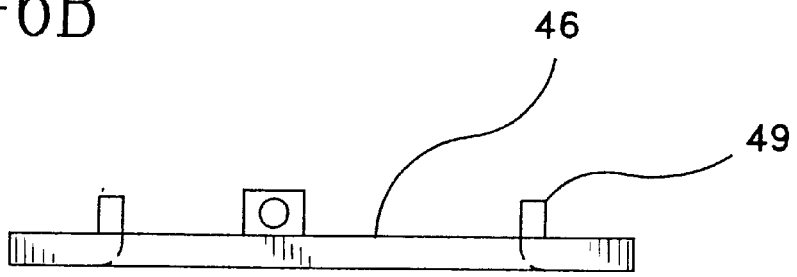
FIG. 6B is a side view of the lock-plate of FIG. 6A.
Figure 6C:
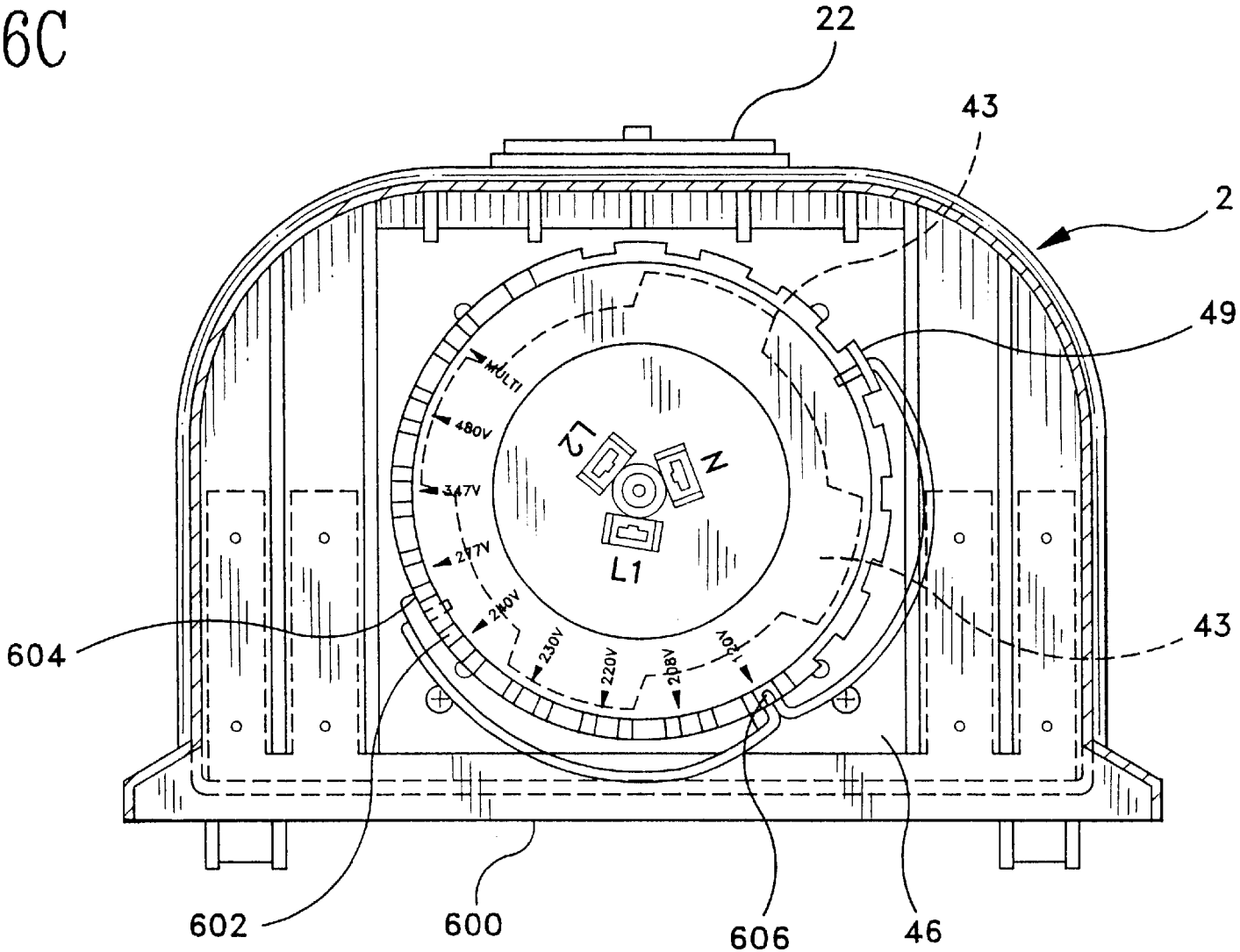
FIG. 6C is a cross-sectional view of a connecting end of an upper housing formed in accordance with the present invention.

In a second embodiment, the lock-plate 46, as shown in FIGS. 6A, 6B and 8, includes a series of tabs 49 extending perpendicular to a surface of the lock-plate for mating connection with a power plug 36. The power plug 36 is held to the lock-plate tabs 49 using any known attachment means, such as a spring clip 600 as illustrated in FIG. 6C. The power plug 36 may be adjusted to accommodate different voltage requirements, as will be discussed later in greater detail, by releasing the spring clip and rotating the power plug to the appropriate setting. More specifically, as illustrated in FIG. 6C which is a cross-sectional view of the connection end of the luminaire, the spring clip 600 includes first and second ends which extend through tabs 49 on opposite sides of the lock-plate 46, at least one of the ends of the spring clip being positioned between two raised walls 602, 604 which identify a voltage rating. The spring clip 600 further includes an alignment loop 606 which is inserted through a tab 49 which identifies the voltage rating of the male plug 36 and ultimately, the power supply voltage to the luminaire. Accordingly, the desired voltage rating is placed in alignment with the spring clip alignment loop 606 to positively identify the luminaire voltage rating. The spring clip 600 may be disengaged from the locking plate without the use of tools to change the voltage rating of the plug to match the power supply voltage. In this embodiment, the lock-plate 46 is adhesively bonded and screwed to the upper housing at its mounting end. The lock-plate 46 of the second embodiment similarly includes a central opening and a series of keyways 43 associated therewith, the function of which is the same as the first embodiment, i.e., receiving the mast mount docking station Referring to FIG. 2, the luminaire 10 is illustrated in an exploded view showing each of the components in the luminaire. Specifically, FIG. 2 illustrates the upper housing 2 having the integrally formed photoelectric control cell socket 22 and hooks 26 for engagement with the detents 28 of the lower housing 4. The upper housing 2 also includes a flange 35 surrounding the dome section in which an adhesive-backed felt or Dacron-polyester gasket 34 can be fitted. The flange 35 also provides a rain lip for preventing rain from entering the enclosed portion of the luminaire. The gasket 34 provides a "breathing seal" gasketing between the lens 35 of the lower housing 4 and the lamp compartment 8 of the upper housing 4 to allow superior filtration.

Figure 7:
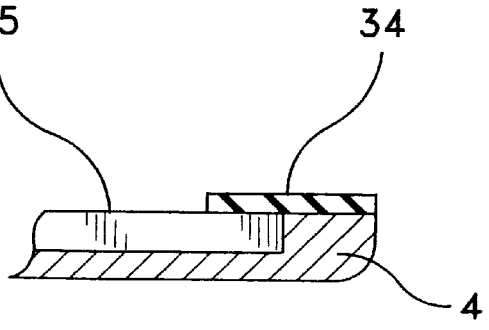
FIG. 7 is a partial cross-sectional view of the lower housing wherein the lens is trapped under the gasket.

In an alternate embodiment, the gasket 34 is fitted to the lower housing as illustrated in FIG. 7. Specifically, the gasket 34 is positioned such that the lens and the edge portion of the lower housing are trapped beneath the gasket. As illustrated in FIG. 10, the upper housing 2 includes a raceway 100 for receiving the wires associated with the light socket mounted therein. The outer edge of the raceway provides a rib 102 which extends into the center of the gasket 34 thus forming an effective seal between the upper housing and lower housing to keep the interior space cleaner, improving component life. The gasket 34 is preferably an adhesive backed felt gasket allowing the gasket to be attached directly to the lens.

The upper housing 2 also provides a mounting surface for a power plug 36. In the embodiment shown in FIG. 2, the power plug 36 is a male plug which is held in position within the upper housing by means of a unshaped clamp 38. Alternatively, the power plug is matingly coupled to the series of tabs 49 provided on the lock-plate 46 illustrated in FIG. 6 via a spring clip as earlier described. Thus, the clamp 38 can be omitted reducing the number of parts and enhancing the maintainability of the luminaire. The power plug 36 provides a connection means from the line voltage to the luminaire ballast circuitry. The terminals 37 of the male power plug 36 are keyed, the purpose of which will be described later in greater detail.

The upper housing 2 is further provided at its plug connection end with a groove for receiving an o-ring type seal 42. The groove is designed to include interference flanges 44 so that the seal 42 can be fixedly press-fit into the housing without the use of a bonding agent The o-ring seal 42 provides for a water-tight seal between the luminaire and the mast mount docking station 6. In the preferred embodiment, the seal 42 is a specially designed seal as illustrated in FIGS. 13 and 14.

Figure 13:
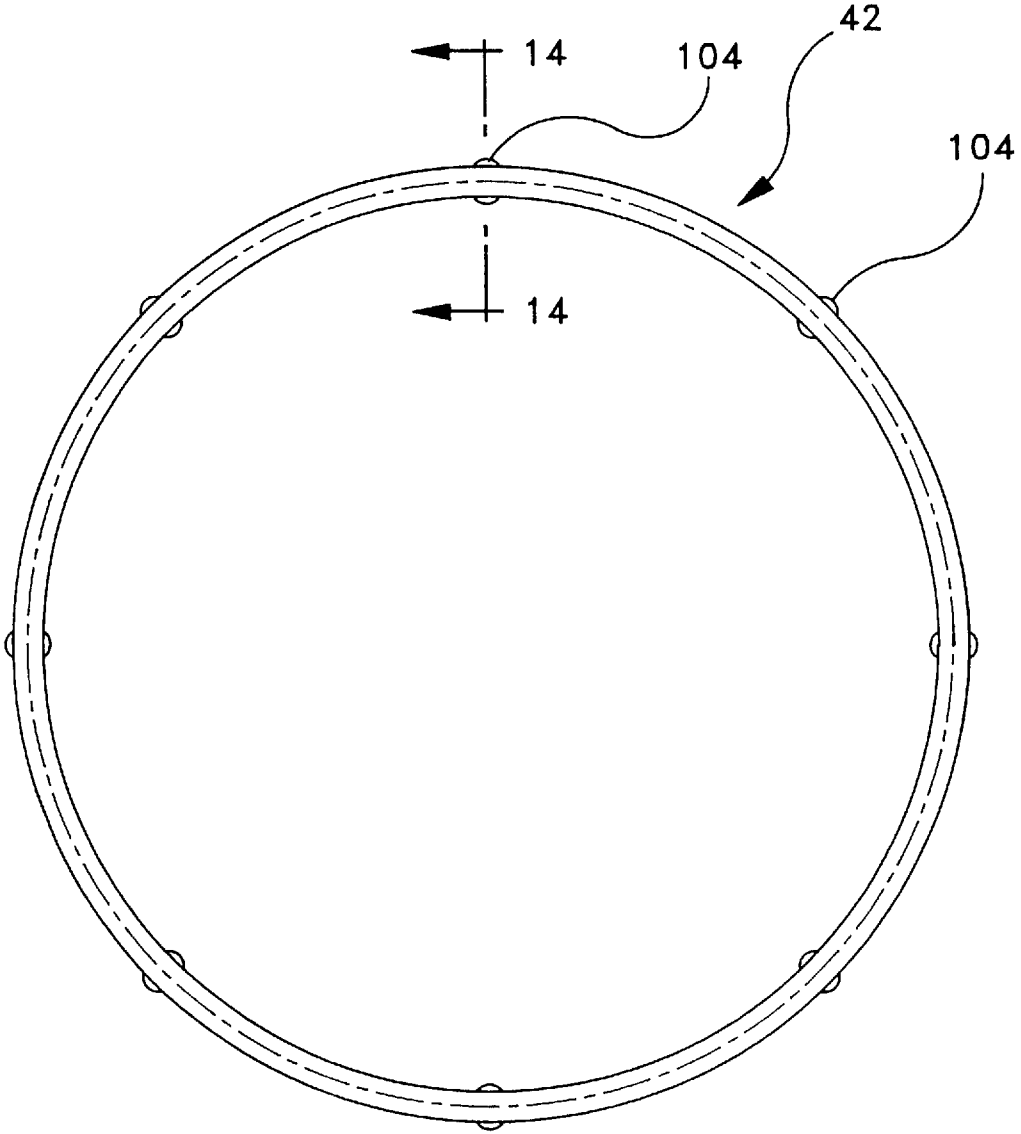
FIG. 13 is a top plan view of an O-ring seal formed in accordance with the present invention.
Figure 14:
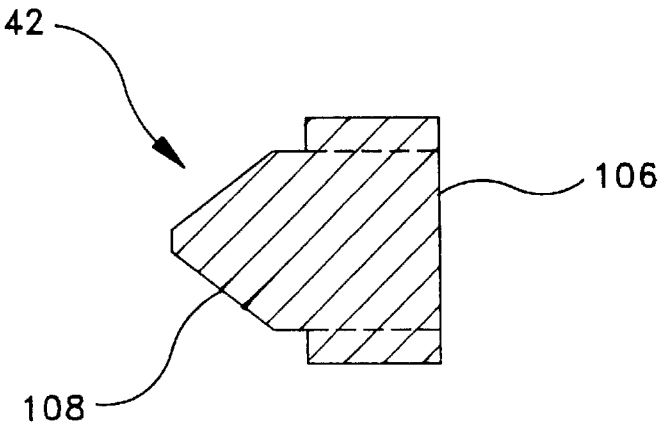
FIG. 14 is a cross-sectional view of the O-ring seal shown in FIG. 13 taken along lines 14—14.

As shown in FIG. 13, the seal 42 in the shape of an O, includes a series of projections or cylinders 104 on the inner and outer edges for engagement with the interference flanges 44 of the groove in the upper housing receiving end. FIG. 14 is a cross-sectional view of the seal illustrated in FIG. 13 taken along lines 14—14. The seal 42 includes a substantially flat rear surface 106 for engaging the bottom surface of the receiving groove. The opposing edge of the seal 108 is substantially frustoconically shaped. This seal 42 provides an environmental seal between the upper housing 2 and the mast mount docking assembly 6 upon interconnection therebetween. Furthermore, the seal 42 absorbs shock by causing a varying natural frequency to prevent harmonics which may be transmitted to a luminaire from the pole thus prolonging component life.

As previously discussed, the lower housing 4 is maintained in a closed position with respect to the upper housing by means of a latch 32. As shown in FIG. 2, the latch comprises a latching device 39 at one end and lances 41 at the opposite end. The lances of the latch allow the latch to be lockingly engaged into a corresponding integrally molded receptacle (not shown) in the upper housing, thereby eliminating the need for additional hardware to mount the latch.

Figure 9A:
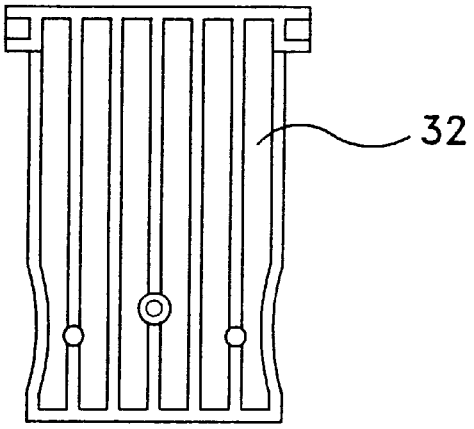
FIG. 9A is a front view of a toggle-type latch.
Figure 9B:
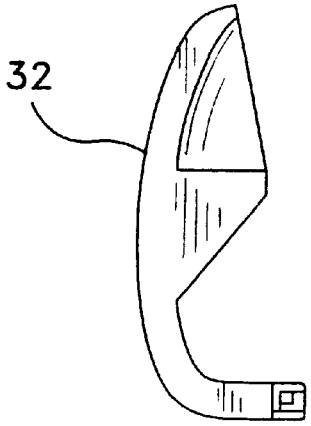
FIG. 9B is a side view of the latch of FIG. 9A.

Alternatively, the latch 32 may be an external toggle-type latch, similar to latches commonly used on a lunch box Such a latch is illustrated in FIGS. 9A and 9B. The latch connection boss of the upper housing is illustrated in FIG. 8. Accordingly, no tools would be required to open the housing assembly to access the lamp or ballast circuitry. The toggle-type latch provides for a positive locking means closing the upper and lower housing interface while being simple to manufacture and operate. Furthermore, the toggle-type latch allows the latch to be opened yet still hold the door from swinging completely open until the latch is disengaged from the door edge.

Figure 15A:
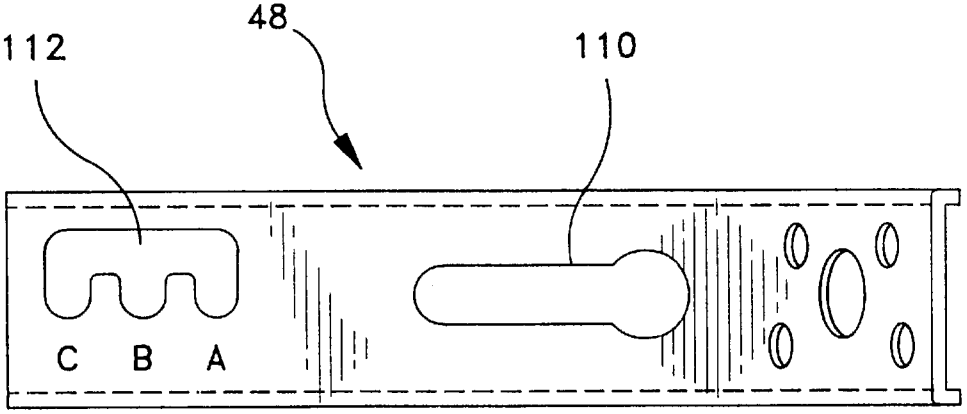
FIG. 15A is a top plan view of a lamp socket bracket for use in a luminaire formed in accordance with the present invention.

FIG. 2 also illustrates that the lamp socket 14 is connected to the upper housing 2 via a socket bracket 48. The socket bracket 48 preferably includes three sets of mounting holes 47 thereby making the relationship of the light bulb with the reflector adjustable for different roadway types, i.e., narrow road or wide road. A preferred form of the socket bracket 48 is illustrated in FIG. 15A The bracket 48 includes a first slotted portion 110 for receiving a first bolt and a second three-position slotted portion 112 for adjustably securing the bracket to the upper housing. The bracket 48 is designed to hold the socket tilted with respect to a horizontal plane of the luminaire. The electrical wiring from the socket 14 to the ballast circuitry is trapped between the upper housing flange 35 and the gasket 34 thereby protecting the wiring within the luminaires. Alternatively, when the gasket 34 is positioned on the lower housing as previously described, the upper housing flange 35 preferably includes interference ribs or a raceway 100 therein such that the socket wiring is wedged within the raceway between the ribs thereby holding them securely in place.

Figure 12:
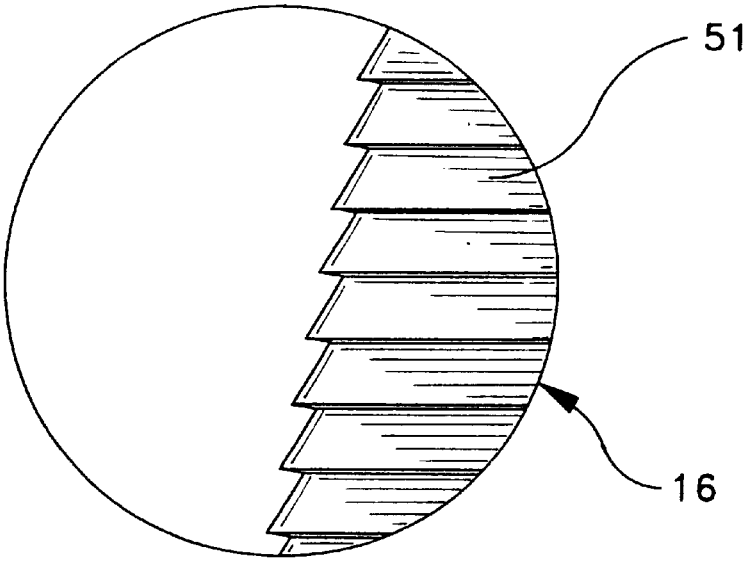
FIG. 12 is an exploded view of section B of FIG. 11.
Figure 11:
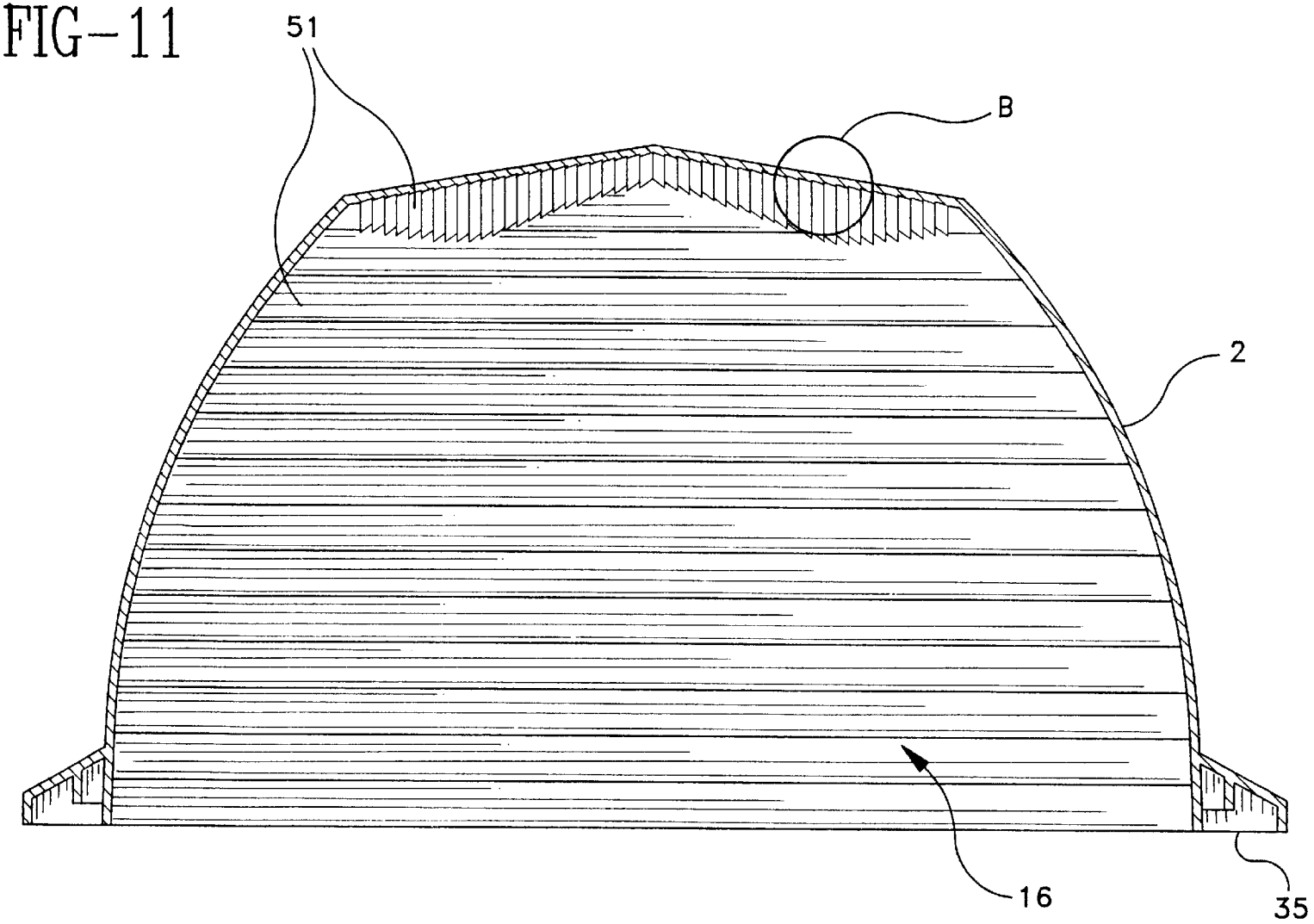
FIG. 11 is a cross-sectional view of the upper housing taken along lines A—A of FIG. 10.

The lamp socket 14 is preferably positioned between approximately a 15–25 degree angle with respect to a horizontal plane taken through the center-line of the upper housing 2. The adjustably position bracket 48 and angled socket in combination with the geometric design 51 of the luminaire reflective surface 16 produces enhanced photometric performance. More specifically, the luminaire has true horizontal cutoff performance in photometric. The geometric design of the reflector 51, as illustrated in FIGS. 10, 11 and 12, is designed to have more uniform light distribution over a wider area. The geometric design includes a series of substantially triangular-shaped sections or corrugated reflector top section 114 to eliminate hot spots directly under the fixture on the roadway while utilizing all energy. Furthermore, the geometric design of the reflector is generally formed from a series of irregular tangentially mating curved bands 120 on the sides of the reflector having varying angles with respect to the horizontal and vertical planes of the luminaire to provide optimum light distribution to the target area. The reflector design of the present invention also prevents uplighting or light above the horizontal plane of the reflector opening. Accordingly, light pollution is decreased and driver safety increased especially under wet conditions. Additionally, unlike many known luminaires which include globe-style lenses having refractors, the lens 35 of the present invention is flat, providing a sleek appearance to the luminaire, as well as reducing the surface area exposed to the wind and reducing light pollution. However, due to the design of the present invention, a globe lens may also be used with the same advantageous results.

The lower housing or door 4 as shown in FIG. 2 includes molded recesses 57, 58 therein for receiving components of the ballast circuitry, namely a ballast 52 and a capacitor 54. The ballast 52 is fixedly attached to the lower housing by means of bolts which are received in bosses 56 extending upwardly from a base of the lower housing 4. The molded recess 57 allows air to flow around the ballast 52 for cooling allowing the ballast to operate at a lower temperature to improve efficiency. The recess or cavity 58 for receiving the capacitor is dimensioned so that the capacitor 54 is press-fit into the cavity thereby eliminating the need for any hardware to hold the capacitor in place. The capacitor cavity 58 may include molded ribs 62 which deflect to permit insertion and withdrawal of the capacitor, yet provide a fit snug enough to hold the capacitor in place. Alternatively, the capacitor may be held within the cavity using a clip. The ballast 52 and capacitor 54 are closely fitted in the lower housing allowing the overall size of the luminaire to be smaller than known luminaries and, accordingly, the lower housing 4 preferably includes a heat shield (not shown) between the ballast and the capacitor. The heat shield allows for reduced internal distances between the components thereby reducing the size and cost of the future.

Figure 9C:
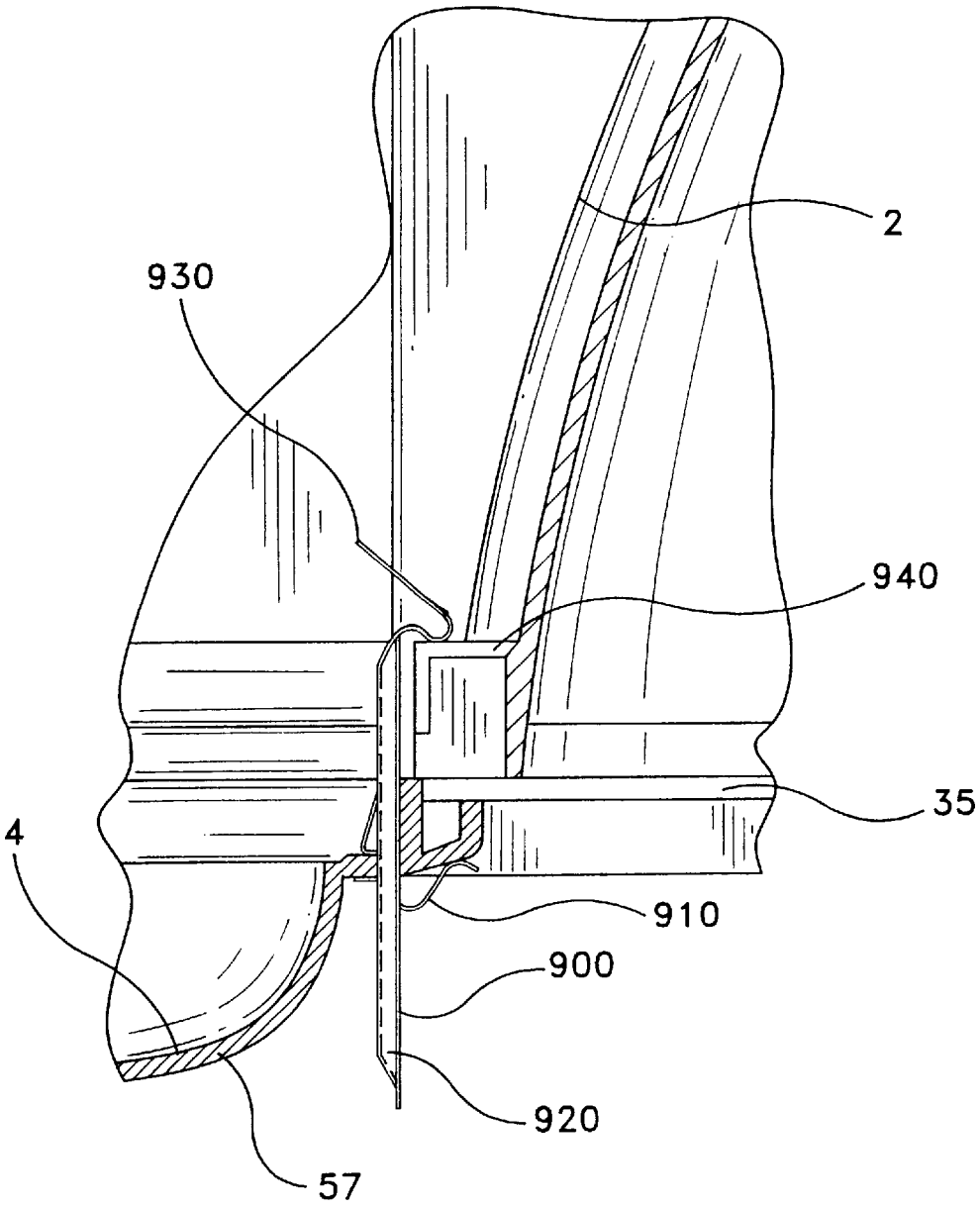
FIG. 9C is a cross-sectional view illustrating an intermediate latch formed in accordance with the present invention.

In some instances, it will be necessary to utilize large ballasts to accommodate the voltage requirements of the luminaire. Such large ballasts may weigh more than ten pounds and place significant stress on the lower housing to which they are mounted. To resist against flexing of the door in the area of a heavy ballast, the present invention may include an intermediate locking means to work in conjunction with the toggle latch to maintain the lower housing in closed relationship with the upper housing. The intermediate latch 900 is preferably positioned between the lens 35 and the recess for the ballast 57 as shown in FIG. 9C. FIG. 9C is a cross-sectional view taken through the intermediate latch 900 with the lower 4 and upper 2 housing in the closed position. The intermediate latch 900 includes a lower end having a first portion biased against the lower housing and a second portion 920 extending downwardly from the lower housing. The upper end of the intermediate latch extends through a slot formed in the lower housing and has a bent end section 930, which, when the lower housing 4 is closed onto the upper housing 2, rides along the outside of the gasket receiving flange 940 thereby positively locking the upper 2 and lower 4 housings. To disengage the intermediate latch 900, the second end portion of the lower end of the latch is manipulated to unlatch the bent end section 930 from the flange 940. Once unlatched, the door may be opened to perform maintenance and repair.

Figure 1A:
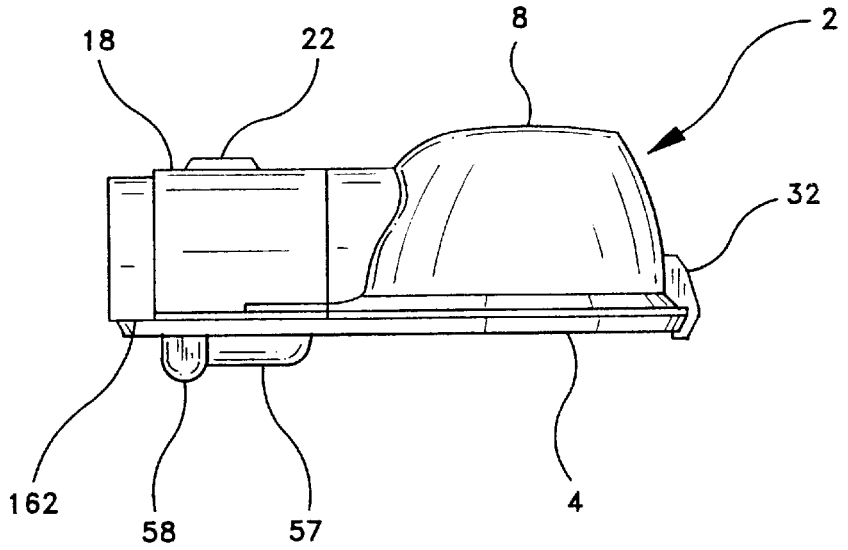
FIG. 1A is a side elevational view of a luminaire having a flat lens formed in accordance with the present invention.
Figure 1B:
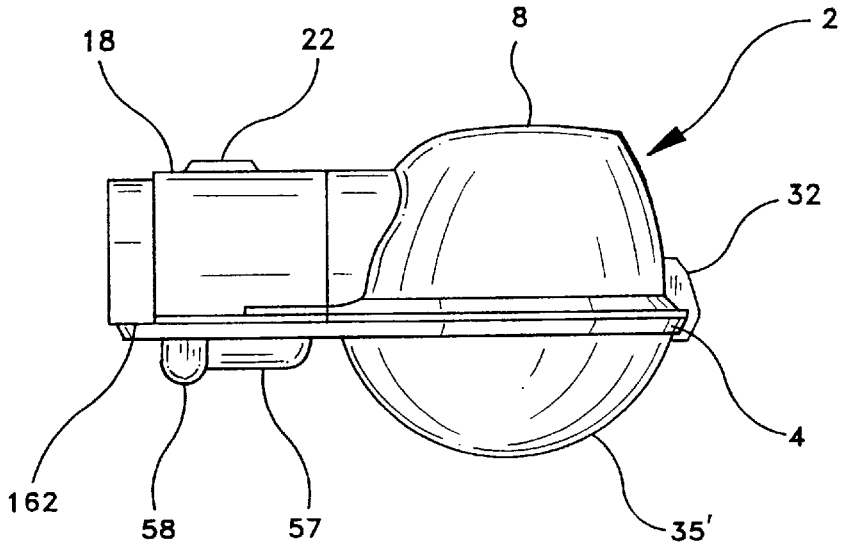
FIG. 1B is a side elevational view of a luminaire having a globe lens formed in accordance with the present invention.
Figure 24:
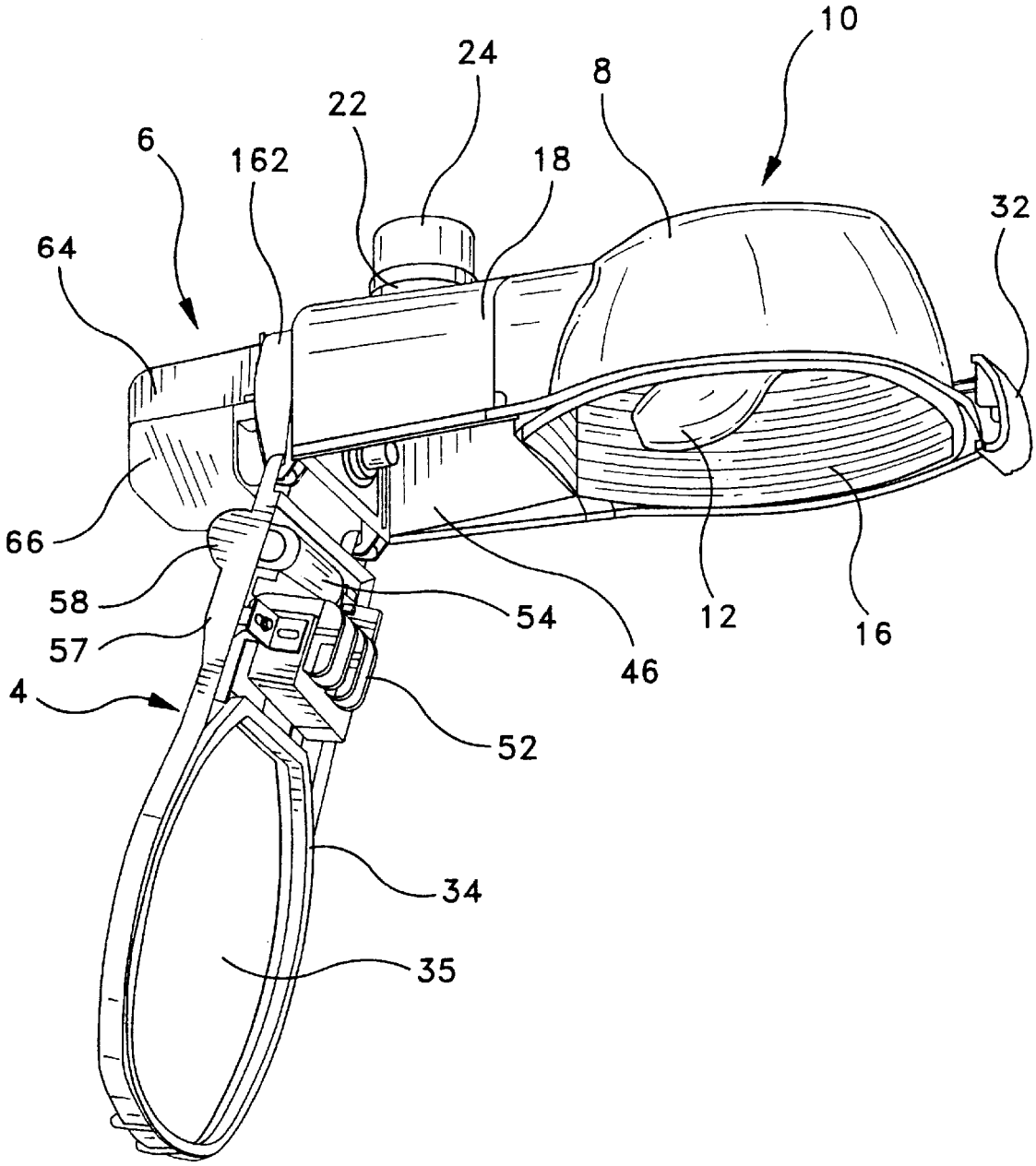
FIG. 24 illustrates an alternative embodiment of a roadway luminaire formed in accordance with the present invention.

Referring to FIGS. 1A and 1B, the luminaire of the present invention is shown in a side plan view. FIG. 1A illustrates a luminaire having the door 4 in the closed position with respect to the upper housing 2 and utilizing a flat lens. The door 4 is maintained in a closed, locked position by the toggle latch 32. Also illustrated in FIG. 1A are the molded receptacles 57, 58 for receiving the ballast and capacitor, respectively. The receptacles extend below a bottom plane of the lower housing 4. The alignment flange 162 is also illustrated in FIG. 1A. FIG. 1B is identical to FIG. 1A, except the luminaire is shown using a globe-style lens 35'. FIG. 24 is a side perspective view of the luminaire illustrated in FIGS. 1A and 1B with like component parts numbered the same.

Figure 15B:
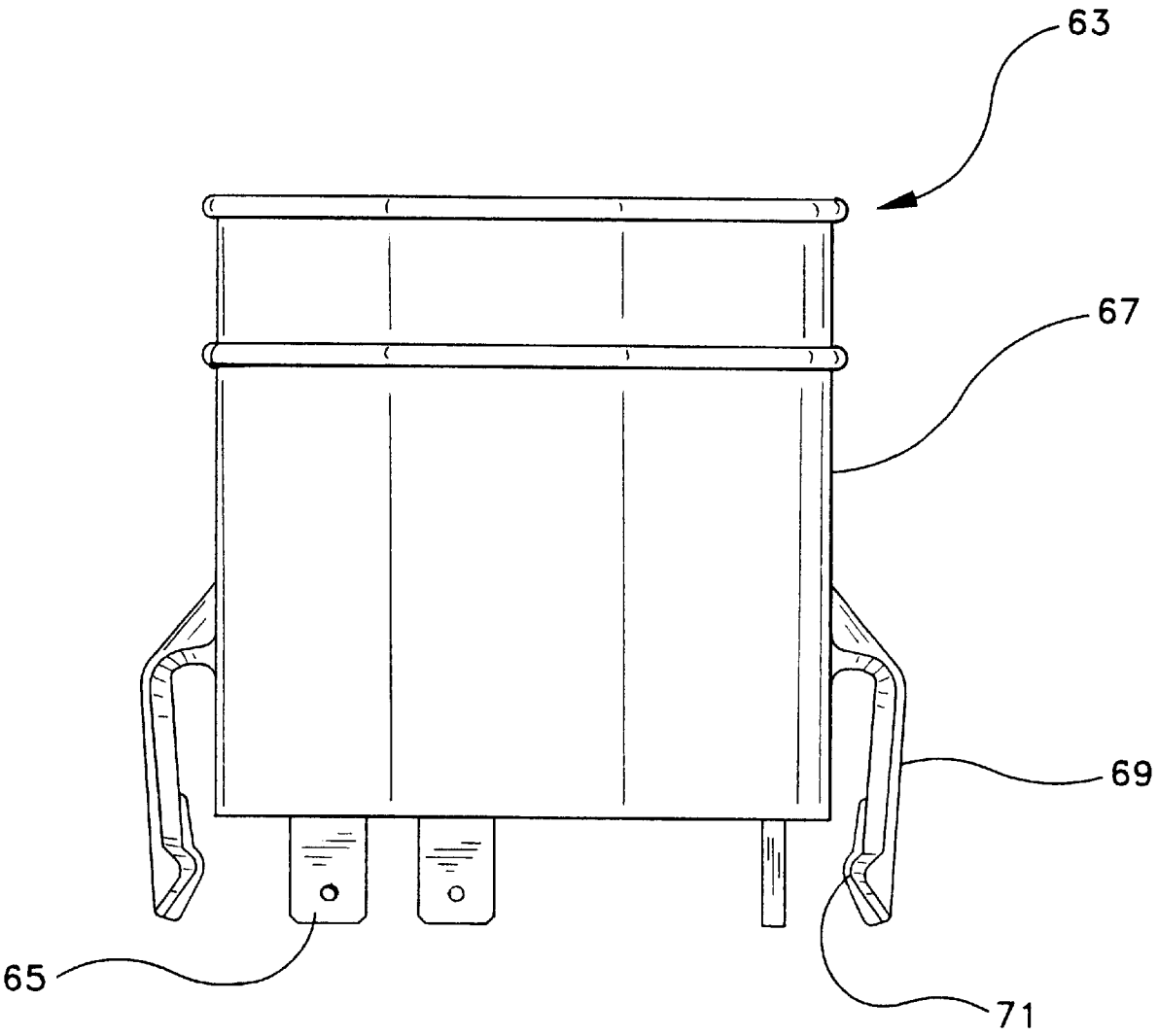
FIG. 15B is a side elevational view of a starter for use in a luminaire formed in accordance with the present invention.

The lower housing 4 further includes a starter receptacle 61 integrated therein. Preferably, the starter receptacle is molded directly into the lower housing 4 and the contacts for the receptacles are slidingly fitted therein. The starter 63 is part of the ballast circuitry of the luminaire. A common failure mode among luminaires using the circuitry of the present invention is starter failure. In known luminaires, the starter is generally bolted to the inside of the luminaire requiring the luminaire to be disassembled to replace the starter. In order to make maintenance of the luminaire of the present invention simple and fast, the starter 63 plugs into the starter receptacle 61 from outside the luminaire housing. The starter 63 includes male terminals 65, preferably three ¼" faston terminals, which are received in the mating female starter receptacle 61. In order to further protect the starter 63 from the elements, the starter 63 is positioned within a molded starter case 67. The starter case 67 and receptacle 61 preferably also include a snap-lock feature to ensure good mating contact between the male terminals on the starter 63 and female receptacle. As illustrated in FIG. 15B, the snap-lock feature is achieved by molding snap-lock receptacles or slotted openings into the lower housing during manufacture and molding on the starter case 67 corresponding mating snap-lock connectors 69 or cantilevered fingers having projections 71 at the distal ends thereof for engaging the slotted openings in the starter receptacle. In the preferred embodiment of FIG. 2, the starter 63, which includes a printed circuit board potted in epoxy to reduce damage from water, dirt, vibration and heat molded within the starter case 67, extends downward from the bottom of the lower housing 4 when the lower housing is in a closed position with respect to the upper housing 2. Accordingly, the starter 63 is protected by the luminaire from direct contact with the elements, yet is easily and readily accessible for maintenance purposes (inspection and/or replacement). Additionally, no tools are necessary when changing the starter due to the snap-lock feature which eliminates any hardware for mounting the starter to the luminaire. Advantageously, the starter may be made to include a printed circuit board positioned within the starter case which is surrounded by a potting material to reduce the occurrence of temperature, moisture and vibration failure.

The ballast circuitry in the lower housing 4 is electrically connected to the upper housing 2, i.e. the lamp socket, via a multiple pin connector (not shown). Most known luminaires have the ballast circuitry mounted in the upper housing whereas the present invention mounts all the components of the ballast circuit in the lower housing. This design allows for easy maintenance when the lower housing or door 4 is swung open. Furthermore, the entire lower housing assembly including the ballast circuit may be replaced simply by unplugging the multiple pin connector and lifting the lower housing off the upper housing hooks 26. Alternatively, the type of luminaire can be changed by replacing the lower housing with one having a different ballast circuit. Accordingly, the maintenance procedure for the luminaire of the present invention is greatly simplified. To repair a failed luminaire, the maintenance worker would check the lamp, the photoelectric control cell and the starter. If none of these appear to be the problem, the ballast or capacitor may be replaced or the entire lower housing 4 can be replaced. Alternatively, the entire luminaire can be replaced by twisting the luminaire 10 off the mast mount docking station 6 and twisting on a new one. The twist-lock feature of the present invention will be described in greater detail below.

Figure 15C:
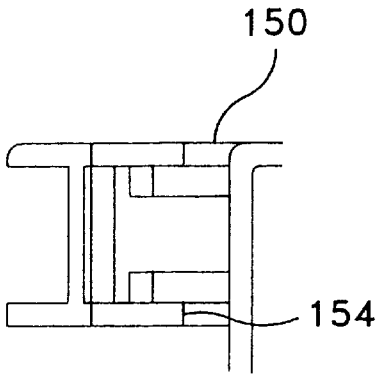
FIG. 15C is a top plan view of a lower housing hinge assembly.
Figure 15D:
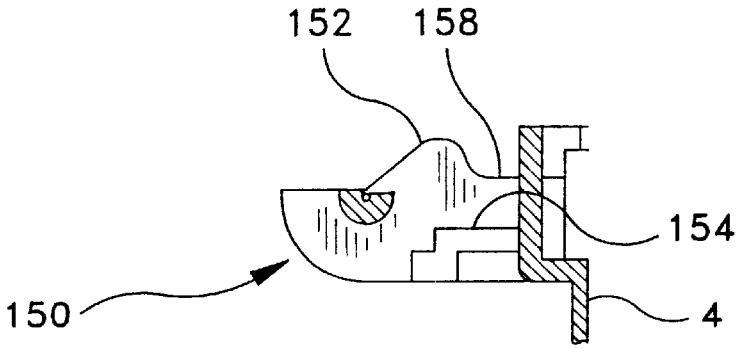
FIG. 15D is a side elevational view of the lower housing hinge assembly shown in FIG. 15B.

Referring to FIGS. 15C and 15D, the mating hinge 150 of the lower housing 4 is shown in detail. This hinge design is an alternative design to that shown in FIG. 2. More specifically, the hinge 150 includes a camming rib 152 and hinge engagement ribs 154. The hinge includes a central rod 156 which is seated within the upper housing hook 26 when assembled. To improve operability of the lower housing hinge 150 when opening the luminaire on a table top, the camming rib 152 allows the lower housing or door to be opened without binding even though being inverted. The slotted portion 158 next to the camming rib 152 is seated within a lower ledge of the upper housing. The upper housing ledge, upon opening of the door 4 rides along the rounded camming rib 152 to prevent binding. The hinge engagement ribs 154 extend to engage the rounded surface of the upper housing hook 26 preventing the door from being removed until the door is opened more than approximately 135° from the closed position. Once the hooks 26 clear the hinge engagement ribs 154, the door 4 is free to be lifted away from the upper housing for repair or replacement. The hinge engagement ribs 154 provide a mechanical means for maintaining engagement of the upper and lower housing until such disengagement is desired.

Figure 15E:
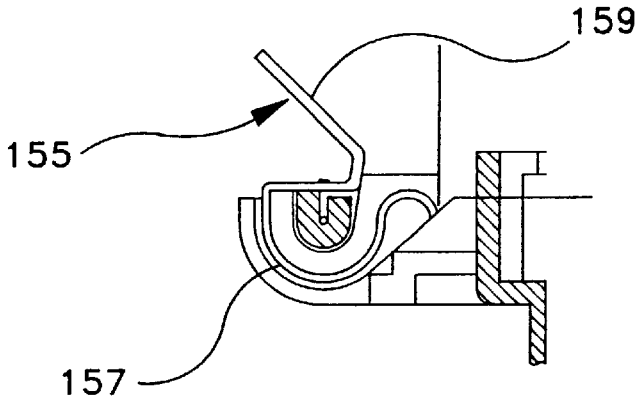
FIG. 15E is a cross-sectional view taken through the upper housing hook and lower housing hinge assembly of a luminaire formed in accordance with the present invention.

As a further safety feature to maintain engagement of the hook 26 and hinge 150 of the present invention, a hinge clip 155 may be snapped over the hook 26 as shown in FIG. 15E. The hinge clip 155 includes a rounded section 157 substantially conforming to the shape of the hook and an upper portion 159 forming a substantially U-shaped portion having one leg of the U extending across a top portion of the hook 26 holding the hinge rod positioned in the hook preventing disengagement therebetween. Upon opening of the lower housing, the hinge clip 155 prevents the lower door 4 from being disengaged from the upper housing 2. To remove the lower housing 4 from the luminaire, the hinge clip 155 must first be removed.

Figure 3:
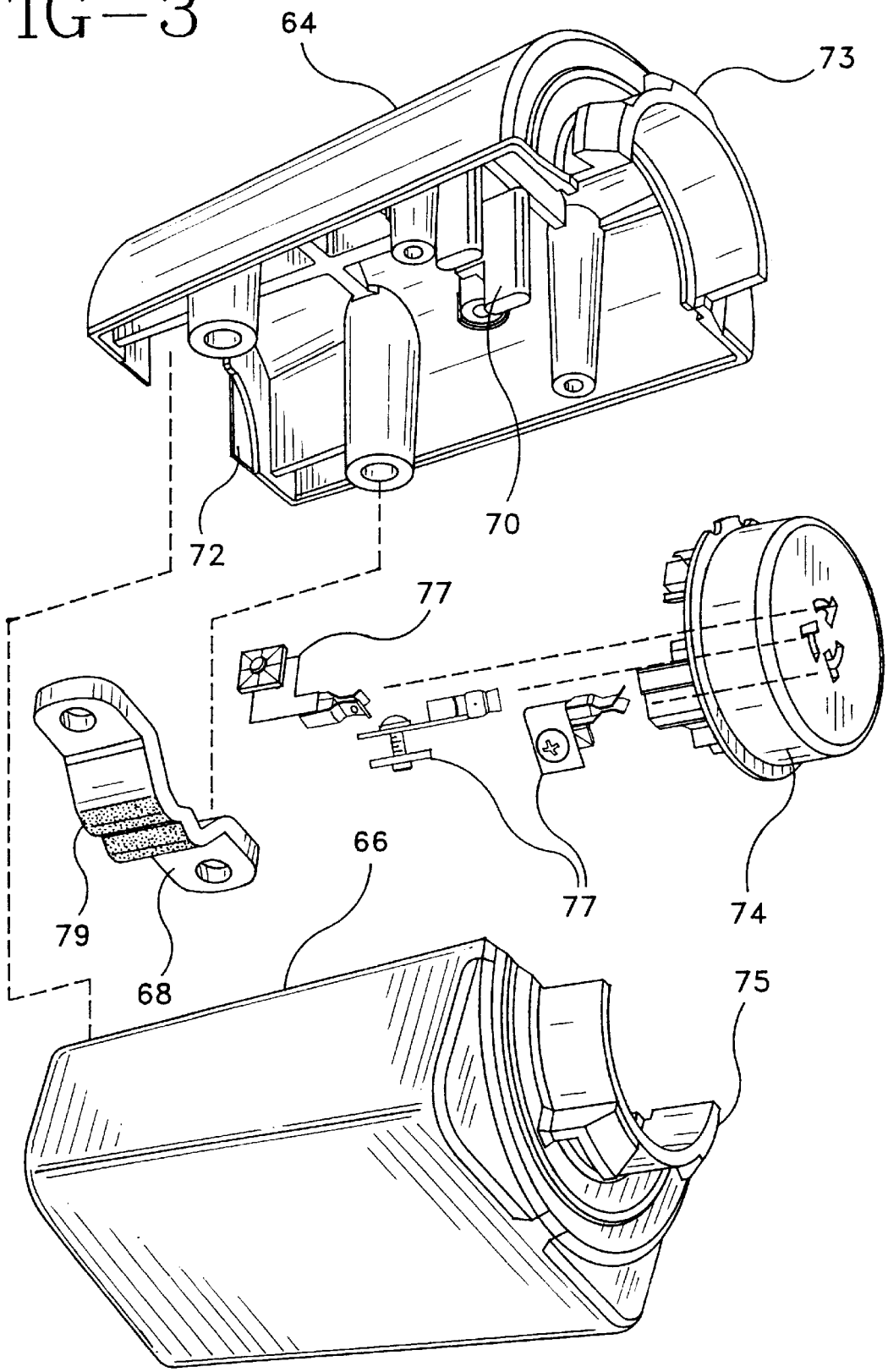
FIG. 3 is an exploded perspective view of the mast mounting assembly including the female power plug of the luminaire formed in accordance with the present invention.

FIG. 3 illustrates an exploded view of the mast mount docking station 6 formed in accordance with the present invention. The mast mount docking station 6 includes an upper mast assembly 64 and a lower mast assembly 66. The mast mount docking station 6 is preferably formed of precision die cast aluminum. The upper mast assembly 64 is secured to the pole mast by a fitter clamp 68 which is attached to the upper mast assembly by a pair of bolts (not shown). Preferably, the fitter clamp 68 includes a gripper portion 79 having a roughened surface for better gripping a pole or mast and to prevent over-rotation of the luminaire to the mast mount docking station upon installation. The mast mount docking station 6 is capable of receiving 1 ¼' through 2" pipe without rearrangement of the clamp 68 or bolts. The upper mast assembly 64 also includes a series of inclined steps 70 for receiving the end of the pole mast. The inclined steps 70 are provided to allow angles of tilt for leveling the luminaire 10 with respect to a horizontal plane to produce maximum light to the surface below. In the preferred embodiment, the inclined steps 70 permit the greatest leveling adjustment presently available, i.e., ±6° with respect to the horizontal plane.

Furthermore, the upper and lower mast assemblies 64, 66, respectively, are provided at one end with a thin wall section 72 which may be removed, similar to a "knockout" in a junction box, thereby allowing the mast mount docking station 6 to receive mast arms of different dimensions and to provide a relatively close fit therewith to prevent animals from entering the mast mount docking station. The upper and lower mast assemblies are provided at the opposite end with a keyed connector 73, 75, respectively, for mating connection with the keyed openings 43 of the twist-lock plate 46 shown in FIGS. 1 and 2. The keyed connector 73, 75 includes a chamfered undersurface 81 to provide a camming action at the joint between the luminaire 10 and mast mount docking station 6 compressing the seal 42 to produce a tight fit therebetween.

Figure 4:
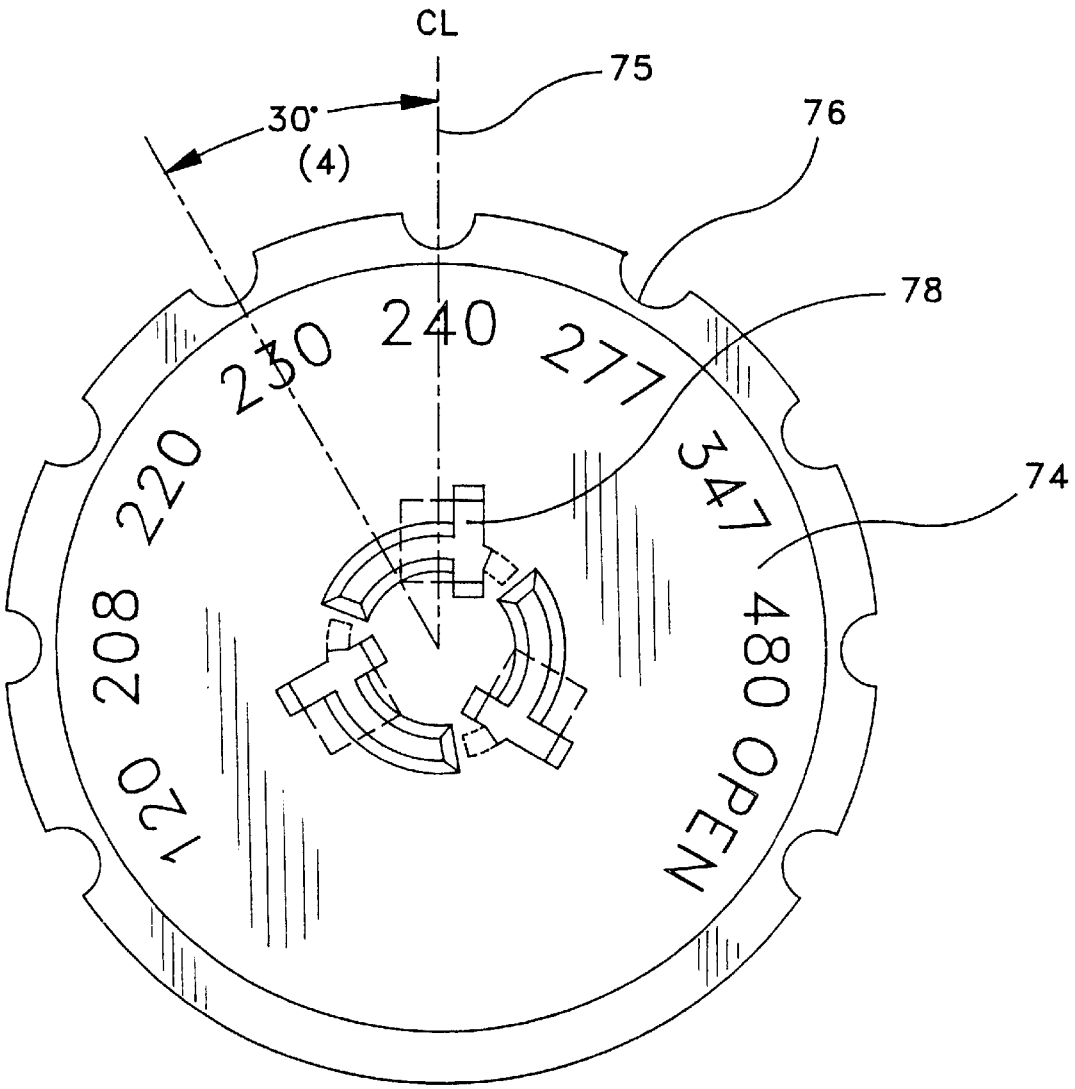
FIG. 4 is an end view of the female power plug formed in accordance with the present invention.
Figure 5:
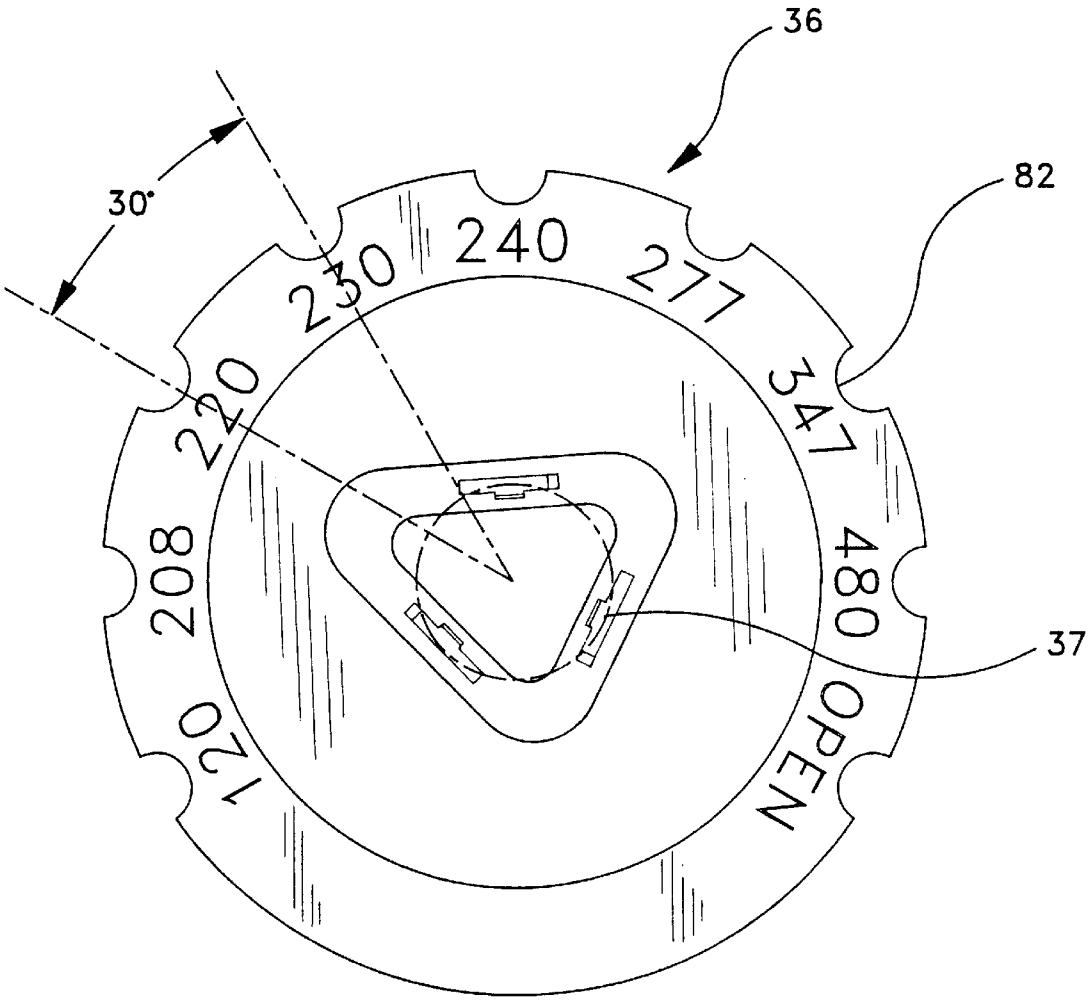
FIG. 5 is an end view of the male power plug formed in accordance with the present invention.

FIG. 3 also illustrates a power plug connector 74 for receiving the electrical power conductors to operate the luminaire. The power plug connector 74 is a female connector and includes three snap-in receptacle terminals 77 which receive the power conductors and are secured thereto by a screw on the side of the terminal. FIG. 4 is an end view of the female power plug connector 74. The plug serves as a receptacle for the male plug connector 36 of the luminaire (FIGS. 1 and 2). The outer circumferential edge of the female power plug is provided with a series of crenulations 76, each identified with a different voltage rating. The plug is designed so that the intended voltage rating of the power supply is oriented in, for example, a vertical position (along center line 75) to thereby identify the proper voltage for the particular luminaire to be coupled thereto. The female receptacle 74 includes three receiving slots 78 which are generally circular or arcuate in shape and have a radially extending portion of the slot for receiving the terminals of the corresponding male plug positioned in the luminaire. The male plug 36, shown in FIG. 5, includes a corresponding set of crenulations 82 and voltages associated therewith. Thus, it will be readily apparent that the luminaire is designed for a specific voltage supply and will be connectable only to a corresponding voltage female plug connector. Accordingly, if the female receptacle is coupled to a 480 V power supply, a luminaire designed for a different voltage rating will not be able to be connected to the receptacle. This safety feature permits the luminaire to be a universal fixture which may be designed to operate at different voltages, yet prevents a mismatch of a power supply and luminaire from being connected together.

The twist-lock feature of the present invention is provided by the interface between the mast mount docking station 6 and the luminaire 10, such that the male and female plugs 37, 74, respectively, are electrically connected upon the mechanical connection of the luminaire 10 to the mast mount docking station 6. Preferably, the twist-lock is accomplished by a rotational movement of the luminaire with respect to the mast mount docking station ranging from about 15°0 to about 30°. The twist-lock feature provides both electrical connection between the male and female plugs as well as mechanical connection of the luminaire 10 to the mast mount docking station 6. Furthermore, the twist-lock feature provides for fool-proof voltage matching between the power source and the luminaire attached thereto. Specifically, the key/keyways of the mast mount docking station 6 and locking plate 46 of the luminaire, respectively, in conjunction with the keyed plug and receptacle are designed so that only corresponding voltage male and female plugs may be electrically connected. Additionally, mechanical stops are provided at the key/keyway interface for providing a stop against over mechanical rotation.

Figure 16:
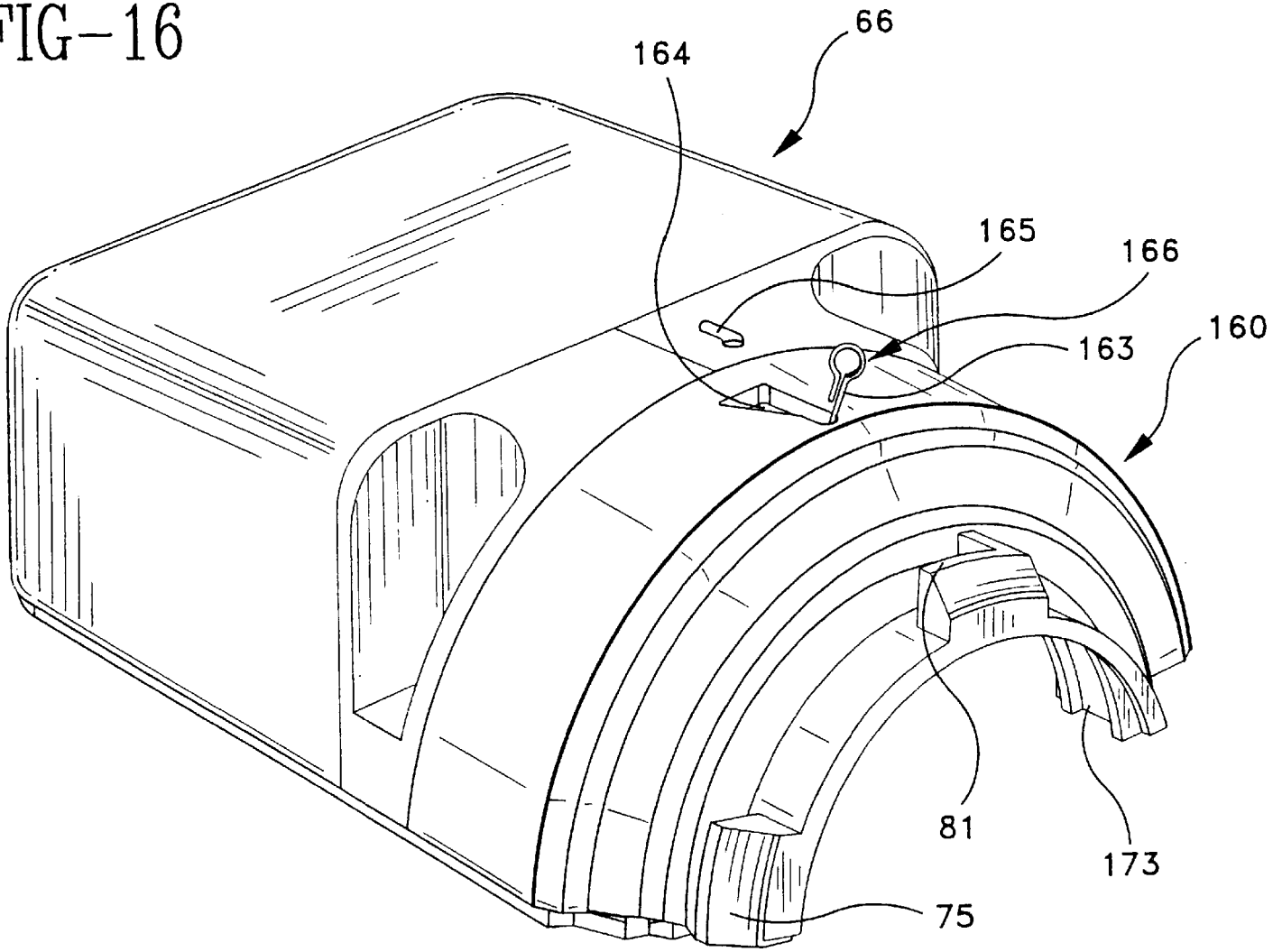
FIG. 16 is a top perspective view of the lower mast assembly formed in accordance with the present invention.
Figure 17:
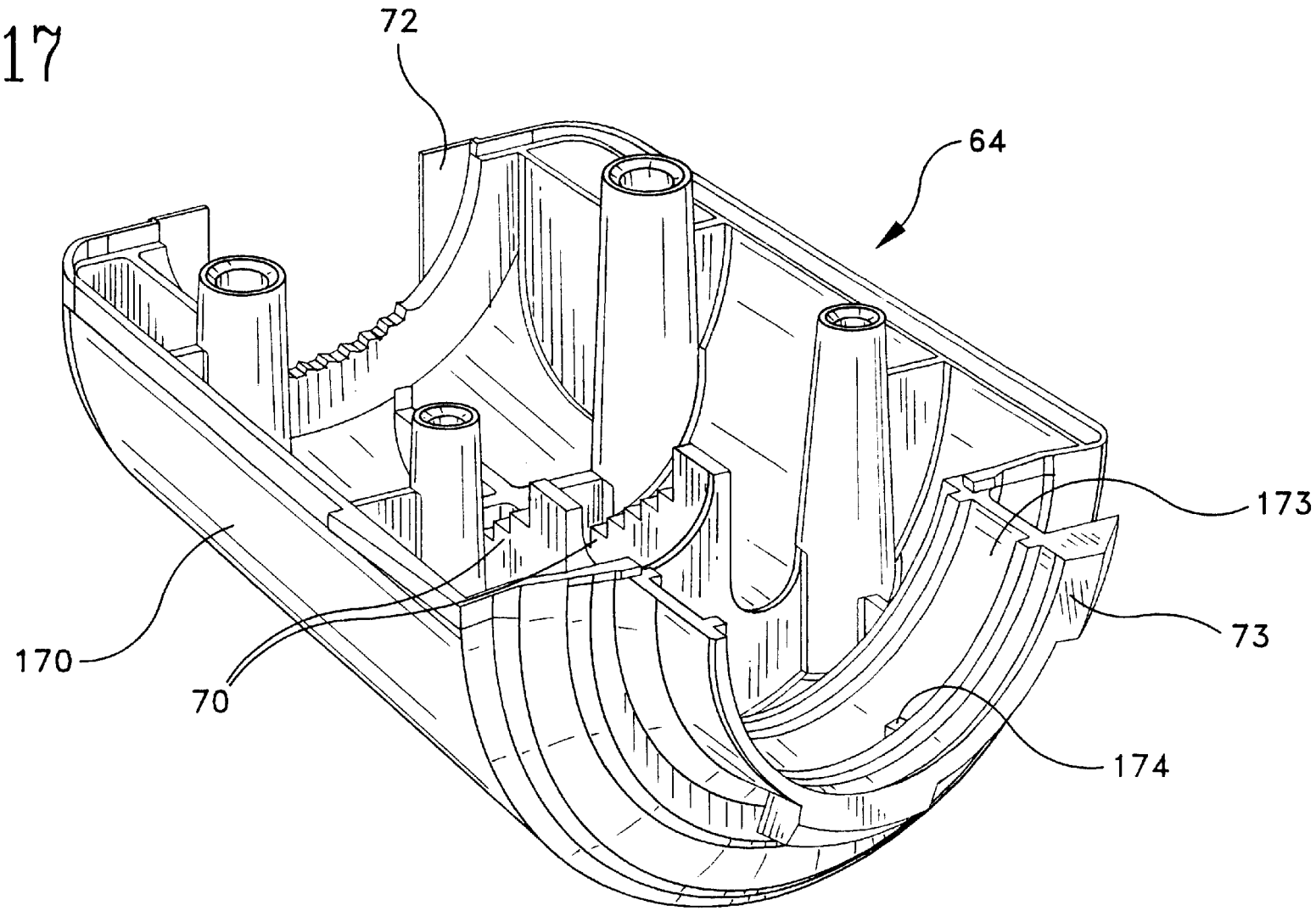
FIG. 17 is a top perspective view of the upper mast assembly formed in accordance with the present invention.

In an alternative embodiment illustrated in FIGS. 16 and 17, the upper and lower mast assemblies 64, 66 respectively, are designed to provide a telescoping feature for mounting a luminaire 10 onto the mast mount docking station 6. More specifically, the lower mast assembly 66 includes at its keyed end a contoured arcuate portion 160. The upper mast assembly 64 has a substantially arcuate center surface 170, which upon connection to the lower mast assembly 66 forms a substantially circular-shaped end portion 160, 170 which is received in an interconnection end of the luminaire. As illustrated in FIGS. 8 and 10, the interconnection end of the luminaire includes an outwardly extending flange 162. Accordingly, upon coupling of the luminaire 10 to the mast mount docking station 6, the circular end portion 160, 170 of the mast mount docking station telescopes into the flange 162 of the luminaire as a guide to aid in the installation of the luminaire. This telescoping feature also serves to protect the seal 42 from ultraviolet ray exposure and rain, prolonging seal life.

As illustrated in FIGS. 10 and 16, a locking means is provided for lockingly coupling the luminaire 10 to the mast mount docking station 6 upon completion of twist-locking the components together. More specifically, as illustrated in FIG. 16, the mast mount docking station lower mast assembly 66 includes a substantially triangular opening 164 in which is mounted a torsion spring 166 having a first end 163 projecting upwardly at a point closest to the keyed end of the lower mast assembly 66 and a second end 165 extending through a hole distally located with respect to the triangular opening 164.

The torsion spring includes a spiral looped portion between the first and second ends to bias the first end toward the keyed end of the lower mast assembly. As shown in FIG. 10, the luminaire flange 170 includes at a lower surface a cutout 172 having a cam pattern to create a locking means with the torsion spring 166 of the lower mast assembly. The flange 170 includes indicia 174 indicating the proper orientation of the torsion spring 166 therein for installation and removal of the luminaire.

Specifically, upon installation of the luminaire 10 onto the mast mount docking station 6, the torsion spring 166 is first aligned with the cutout 172 and deflected rearwardly from its rest position by the first cam section 175 of the cutout 172. Upon rotation of the luminaire with respect to the mast mount docking station, the spring travels along the first cam section 175 until it springs forward reaching its locked position within the second cam section 176. In this position, the luminaire is fully locked in place with respect to the mast mount docking station. To remove the luminaire, the torsion spring 166 is moved to rest on the third cam section 177 of the cutout 170. With the spring 166 resting on the third cam section 177, the luminaire may be twisted off the docking station. The triangular opening 164 allows the spring 166 to guidingly move to rest on the third cam section 177 thereby unlocking the locking means and facilitating removal of the luminaire 10 from the docking station 6. Since the torsion spring 166 is biased to its resting position, the spring automatically resets to prevent the next fixture from being installed without locking. The torsion spring also acts as an alignment guide for initial positioning of the luminaire 10 onto the docking station 6 for installation.

Figure 18:
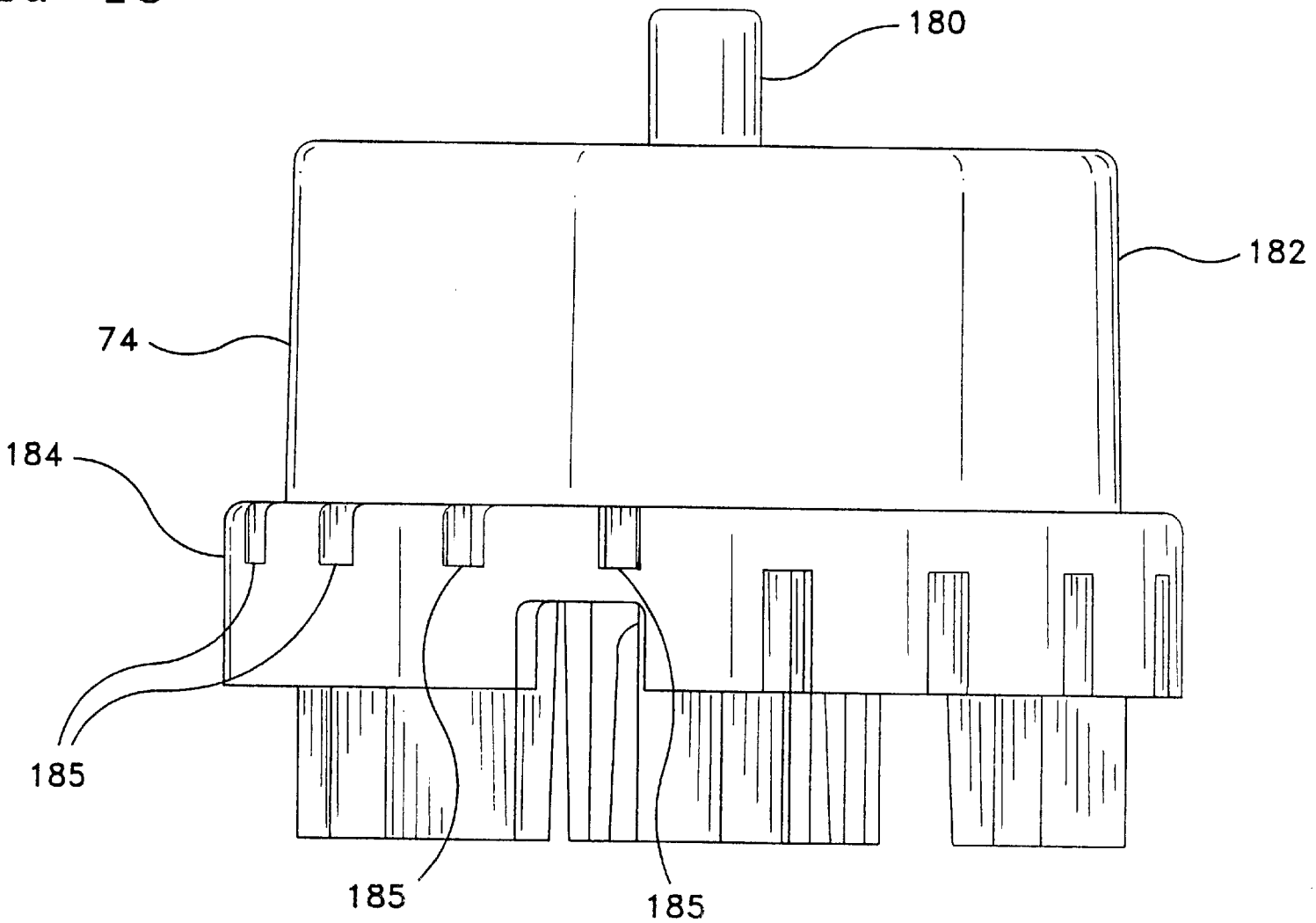
FIG. 18 is a side elevational view of a female plug receptacle formed in accordance with the present invention.

To further facilitate mounting of the luminaire 10 onto the mast mount docking station 6, the male plug 36 and female receptacle 74 are designed to include matingly telescoping portions to aid in alignment for installation. More specifically, as illuminated in FIG. 18, the female receptacle 74 includes a first substantially cylindrical projection 180 located centrally on the receptacle and being surrounded by the female electrical receptacles. The second step portion 182 is also substantially cylindrically shaped and a third step portion 184 is fitted within a mounting groove 173 formed in part in both the upper and lower mast assemblies 64, 66 respectively. Accordingly, when the upper and lower mast assemblies 64, 66 are coupled together, the female receptacle 74 is retainingly mounted in the mounting groove 173. As shown in FIGS. 17 and 18, the upper mast assembly 64 includes a projection 174 which matingly engages a slot 185 formed in the third step portion of the female receptacle to maintain the proper orientation of the receptacle in the mast mount docking station. As previously noted, the female receptacle may be rotated to indicate the voltage of the power supply connected thereto. The mating projection 174 and slot 185 on the receptacle ensure against unwanted rotation after the supply voltage is set.

Figure 19:
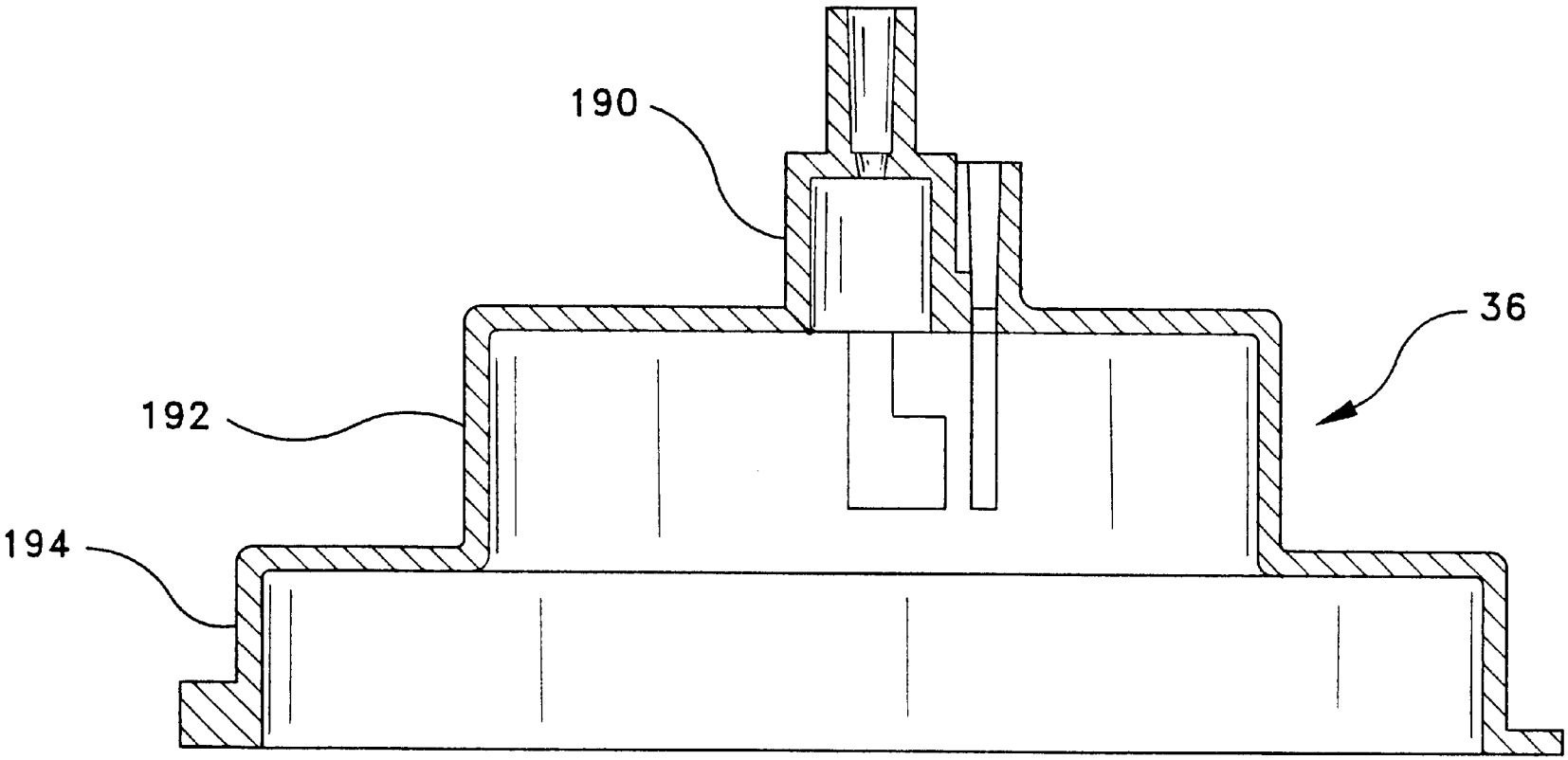
FIG. 19 is a cross-sectional view of a male plug for use in a luminaire formed in accordance with the present invention.

FIG. 19 is a cross-sectional view of the male plug 36 which is mounted to the locking plate of the luminaire. The male plug 36 is formed with three stepped recesses which matingly receive the stepped projections of the female receptacle 74. More specifically, the male plug 36 includes a central axial bore 190, a first stepped recess 192 and a second stepped recess 194. Upon mating of the luminaire 10 to the docking station 6, the projection 180 of the female receptacle is received in the central axial bore 190 of the male plug. The second step portion 182 of the female receptacle is received by the first stepped recess 192. The third stepped recess 194 provides a receiving space behind the locking plate to receive the keyed projections formed on the mast mount docking station 6. Accordingly, upon insertion of the luminaire 10 onto the mast mount docking station, the plug assembly provides a three-step telescoping alignment means to properly orient the luminaire for installation on the docking station. Furthermore, as earlier discussed, the locking means comprising the torsion spring 166 and flange cutout 172 provide further alignment means of the luminaire for mounting onto the docking station.

Figure 19A:
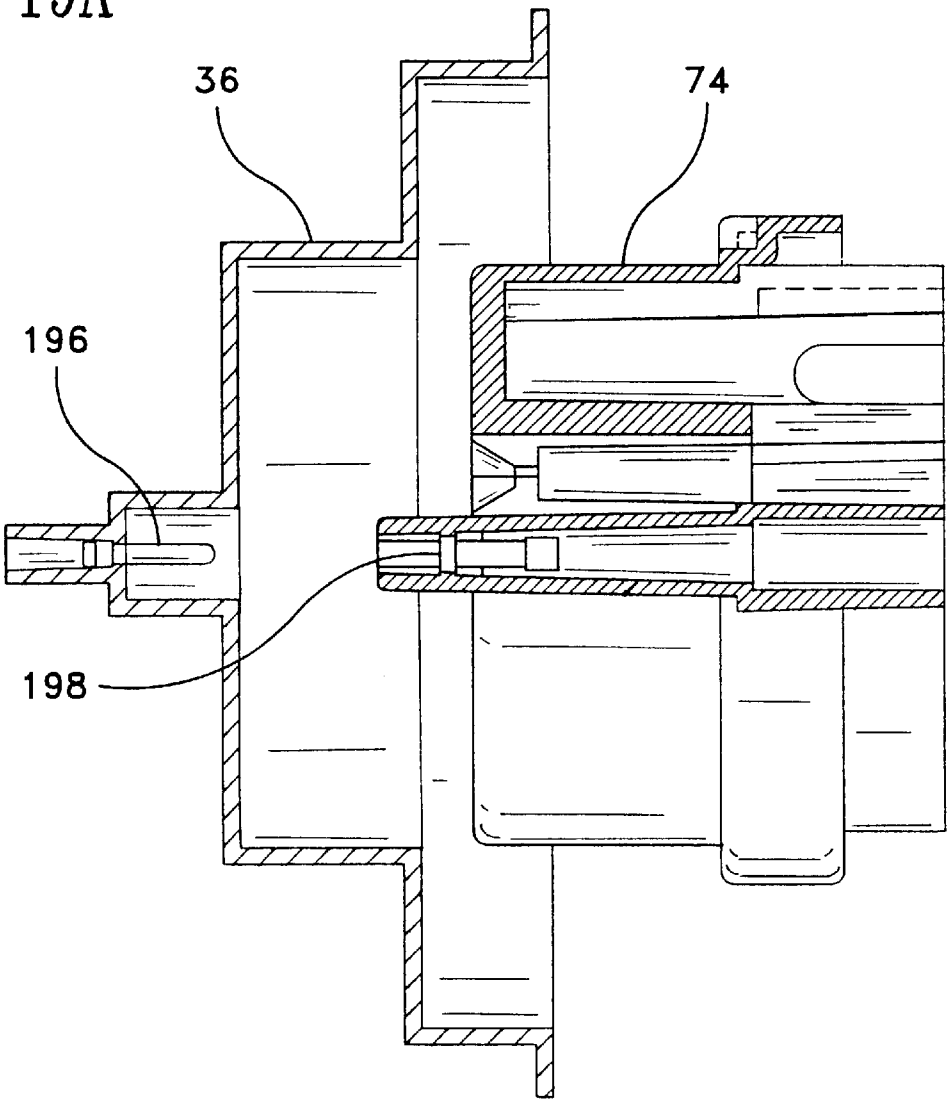
FIG. 19A is a cross-sectional view of an alternative male plug and mating female plug receptacle for use in a luminaire formed in accordance with the present invention.

FIG. 19A illustrates a modified plug/receptacle combination similar to that shown in FIGS. 18 and 19. In FIG. 19A, the male plug 36 is illustrated in cross-section and includes a male ground pin 196 having a termination end coupled to a system ground. The female plug receptacle 74 is shown in partial cross-section and includes a mating female ground pin receptacle 198. The female ground pin receptacle 198 has a termination end coupled to the housing of the luminaire to create an effectively grounded device upon interconnection of the male plug 36 with the female plug receptacle 74.

Figure 20:
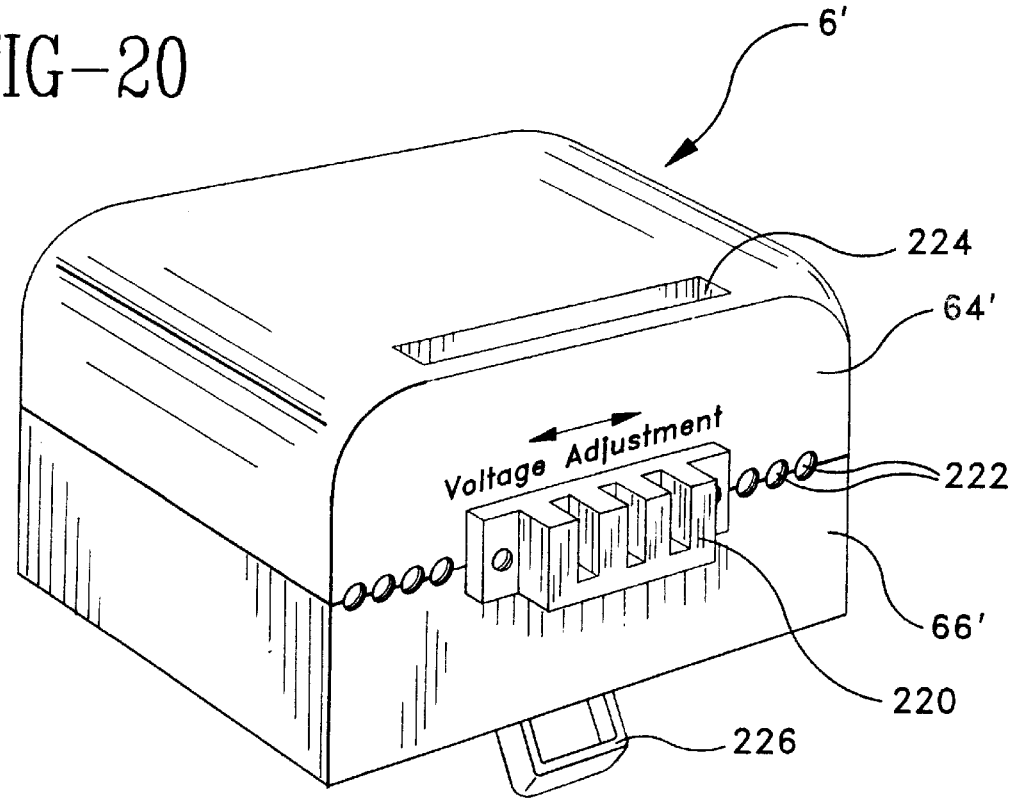
FIG. 20 is an alternative embodiment of a mast mounting assembly and luminaire formed in accordance with the present invention.
Figure 20A:
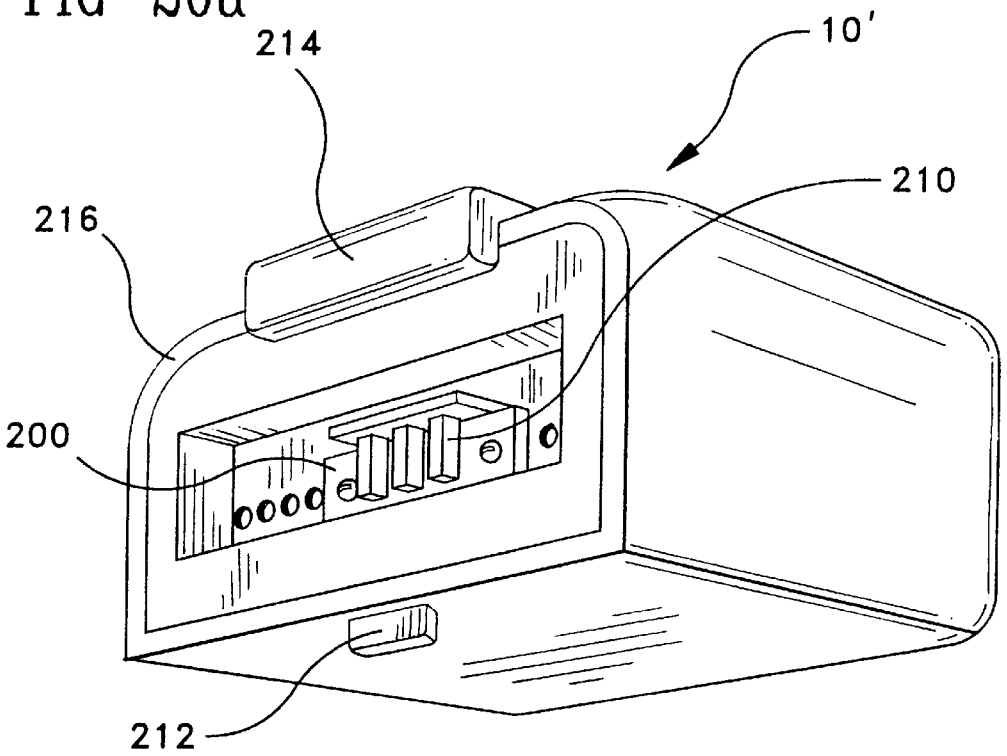

Referring now to FIG. 20, a further alternative embodiment of the present invention is illustrated. The fixture would again include a luminaire and a mast mount docking station 6' comprised of upper and lower portions 64', 66'. However, the mechanical and electrical connection between the docking station 6' and the luminaire 10' are modified from earlier embodiments. More specifically, the electrical connection is made by mating a male connector 200 having contact blades 210 which may be located at the connection end of the luminaire 10' with a docking station 6' female connector 220 for receiving the male connector 200. The male and female connectors 200, 210 may be adjusted to accommodate different supply and luminaire voltages by placing the connectors in appropriate mounting holes 222. Accordingly, electrical connection may be made only if the male and female connectors 200, 210 are in alignment so that mismatching of voltages may be avoided.

To mechanically couple the luminaire 10' to the docking station 6', the luminaire may include a tab-shaped projection 212 on its undersurface and a latching finger 214 extending from a top portion of the luminaire 10'. The docking station 6' may preferably include an elongate recess 224 in the upper portion 64' for receiving the latching finger 214 of the luminaire and a latch 226 for latching engagement with the tab-shaped projection 212. Accordingly, upon mechanical coupling of the luminaire 10' to the docking station 6' by the latch means described above, the male and female electrical connectors 210, 200 become electrically connected. Either the docking station or luminaire may include a gasket 216 therearound to sealing mate the two components upon mechanical coupling together. Furthermore, as earlier discussed with respect to other embodiments, it is possible to include telescoping component portions to enhance alignment and provide greater mechanical strength to the coupling of the luminaire to the docking station.

As previously noted, the luminaire of the present invention provides improved photometric over known luminaires. Several factors contribute to this improvement, the most significant of which is the luminaire reflector. The reflector 16 formed in accordance with the present invention is best illustrated in FIGS. 8, 10, 11 and 21.

Figure 21:
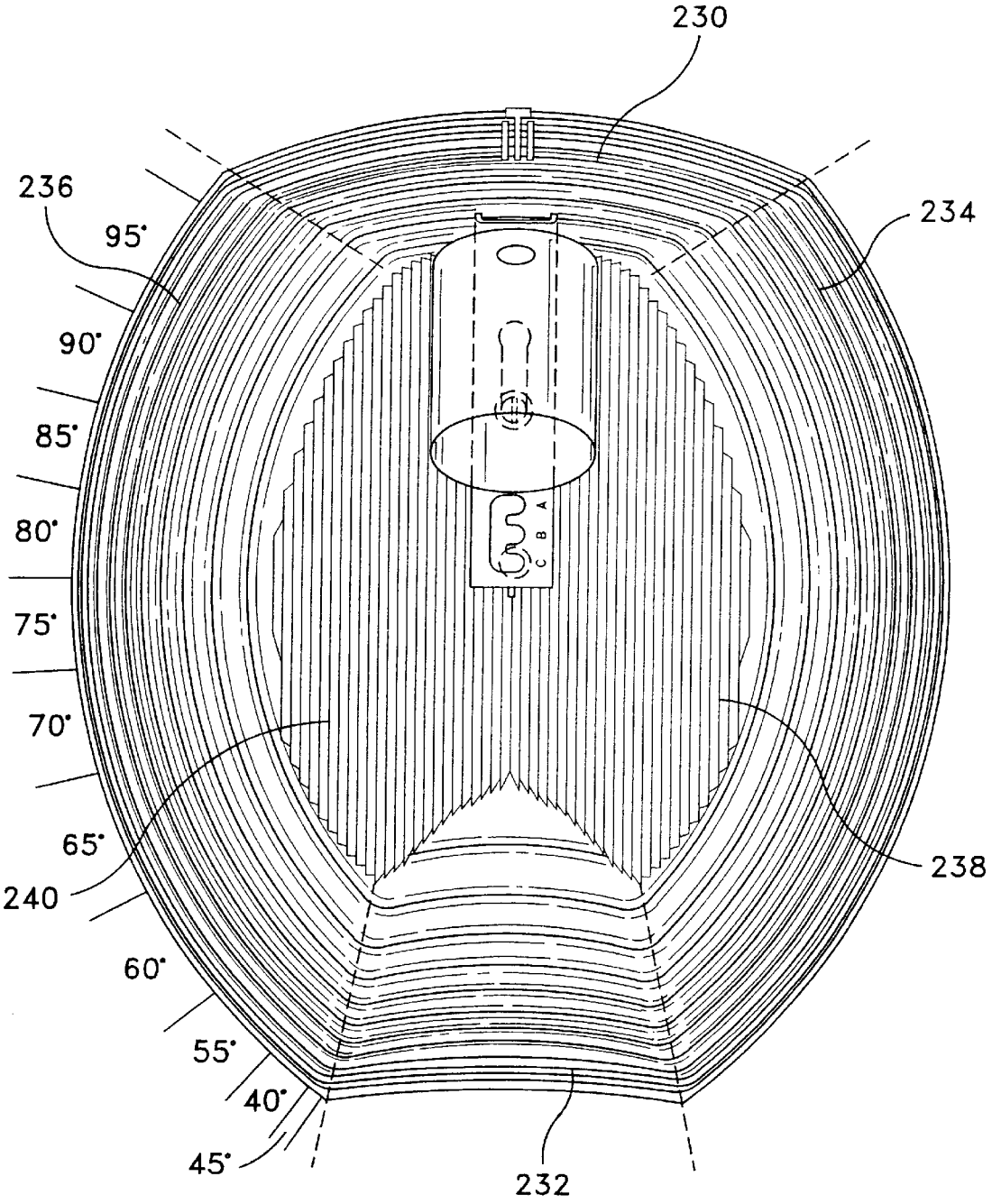
FIG. 21 is a top plan view of the reflector of a luminaire formed in accordance with the present invention.

Referring to FIGS. 10 and 21, the reflector 16 is illustrated in a top plan view. The reflector geometry 51 is comprised of a plurality or horizontally arranged bands 120 specifically designed to control both the horizontal and vertical flux emanating from the reflector. Specifically, the shape or contour of these bands are curved to control the flux horizontally and vertical flux control is achieved by varying the vertical angle of the bands as they curve horizontally. The bands 120 are arranged vertically coupled together with the edges of successive bands being tangent. In the preferred embodiment, each band is approximately one-half inch in height. Each band is curved so that they are irregular with respect to the horizontal and vertical axes as they progress around the reflector. Since each band is curved, no flat surfaces exist, and undesirable flux concentrations known as "hot spots" are avoided.

Referring to FIG. 21, the reflector 16 can be divided into six main surfaces which control the distribution of light therefrom. The six sections are defined as follows: house side reflector section 230 which reflects the light towards the house side of the street; street side reflector section 232 which reflects light across from the mounting pole and up and down the road; right side reflector section 234 which reflects light up the road to the left of the fixture; left side reflector section which reflects light down the road to the right of the fixture; top right side reflector section 238 which reflects light up the road to the left of the fixture; and top left side reflector section 240 which reflects light up the road to the left of the fixture. The house side and street side reflector sections 230, 232 generally emit minimal light with the street side reflector section emitting more than the house side section. The right side section 234 and left side section 236 emit the main portion of lighting, providing the high candle-power required for fixtures mounted high above a roadway.

The reflector 16 having the geometry illustrated in FIGS. 10 and 21 is most effectively formed by a vacuum metalization process over the molded composite housing as earlier discussed. This process is more accurately repeatable than hydroformed aluminum disks commonly used in roadway luminaires. Specifically, the molded composite housing forms the bands and a high purity metal having 85–90% reflectivity is applied directly to the molded form to create the reflector. Hydroformed reflectors are known not to be accurate and therefore use refractors to mask those inaccuracies. The present invention overcomes these disadvantages. Additionally, since the composite housing is an insulator, there is no need for grounding the fixture.

Another advantage of a highly accurate reflector is that a smooth flat lens may be utilized as opposed to a lens requiring a prismatic refractor. A smooth refractor or lens is more efficient since the control is closer to the energy source. Accordingly, there is no uplighting or light above the horizontal plane of the reflector opening due to a prismatic refractor. The highly accurate reflector of the present invention may be used in conjunction with either a smooth flat or sag lens having no refractor.

Figure 23:
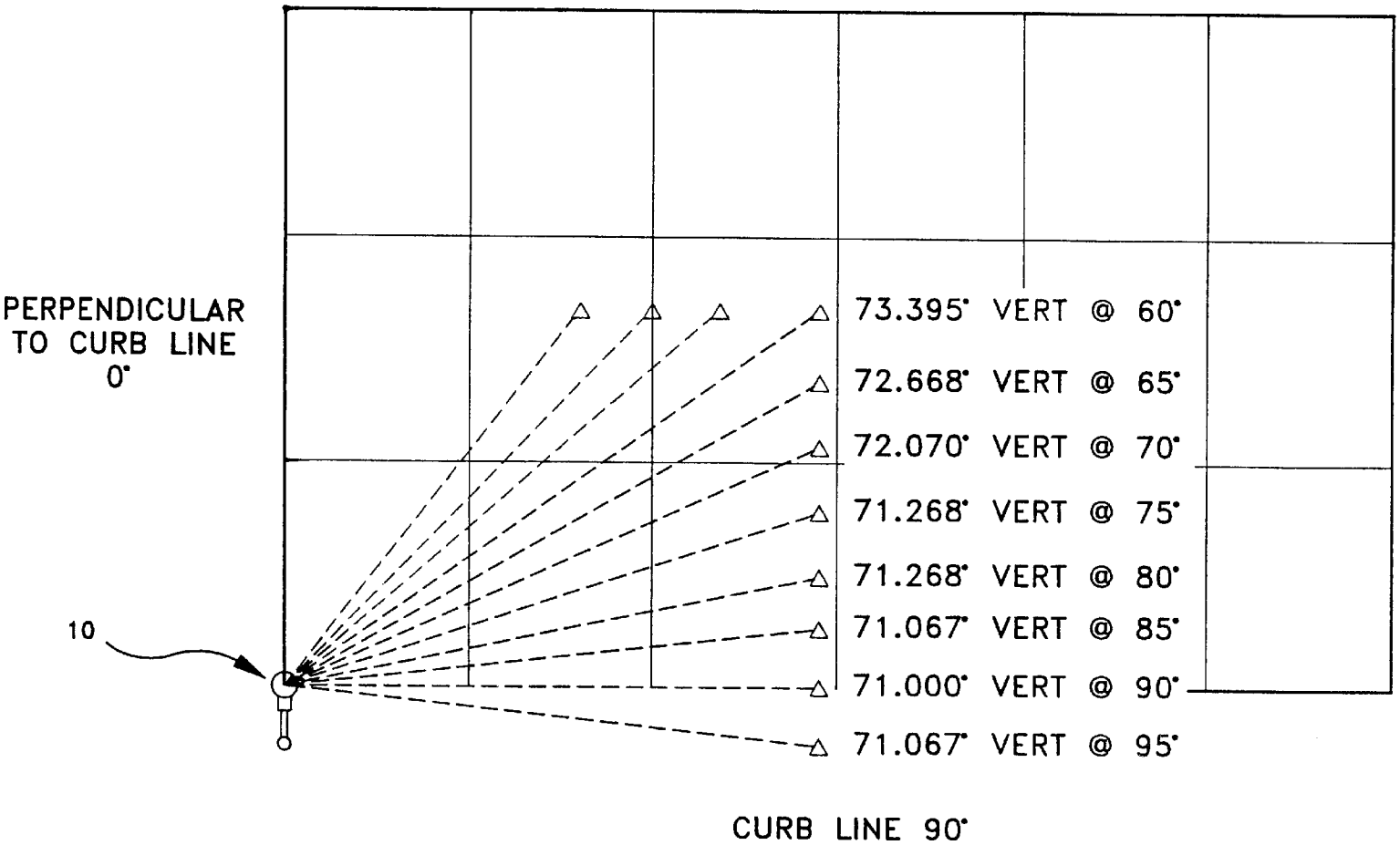
FIG. 23 is a chart illustrating the light flux emanating from the aiming band closest to the reflector opening as illustrated in FIGS. 21 and 22.

Also shown in FIG. 21 is a preferred distribution of the aiming bands forming the reflector. Each aiming band is angularly displaced along its contoured length with respect to the horizontal and vertical axes. More specifically, each aiming band may be defined by a series of parabolic aiming sectors which direct light to a specific location on the ground as illustrated in FIG. 21. Referring to FIG. 23, the light distribution pattern for the right side reflector section aiming band closest to the reflector opening is illustrated. The light pattern from the aiming band is shown in graphical form such that the y-axis is at 0° with respect to a horizontal axis of the luminaire and is perpendicular to the curb line. The x-axis is illustrated as being along the curb line, 90° with respect to the horizontal axis. The grid in FIG. 23 is made up of mounting heights, i.e., one unit is equal to the mounting height of the luminaire above the ground. The light pattern illustrated in FIG. 23 corresponds to the light reflected by each aiming band sector of the aiming band closest to the reflector opening as shown in FIG. 21. In view of the desired light pattern, each aiming sector varies in arc length around the reflector. As an example, to achieve a pattern of the light being reflected by the lowest aiming band in the reflector to 90° with respect to the horizontal axis, the aiming band sector must be at a 71° angle with respect to the vertical axis, i.e., the exit angle of the reflected light. Each aiming band sector varies in both the horizontal and vertical axes angles to achieve the desired light distribution.

Figure 22:
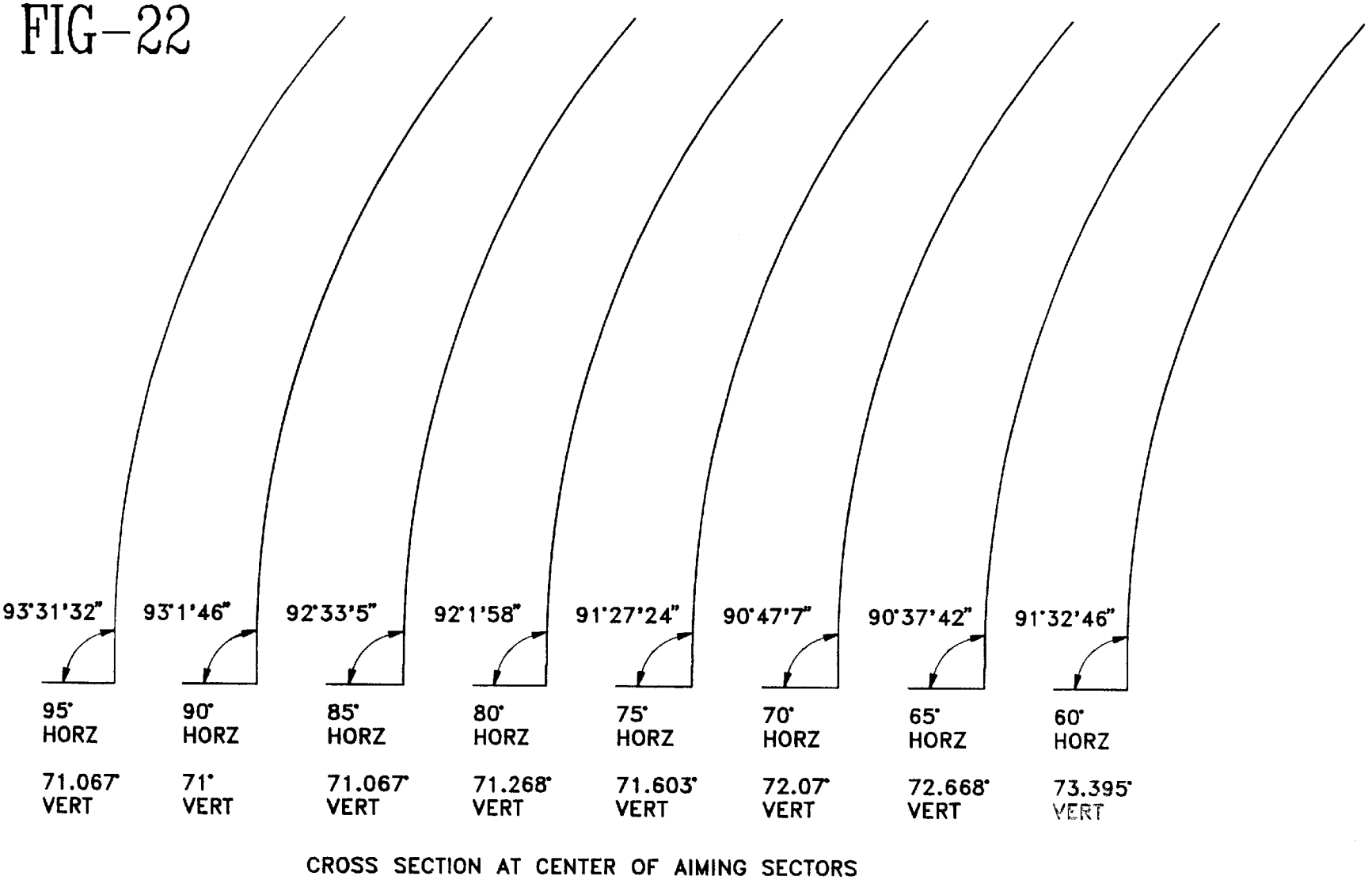
FIG. 22 is a cross-sectional view of the aiming band closest to the reflector opening taken through the center of the aiming band.

Referring now to FIG. 22, which is a cross-sectional view of the right side reflector section through a center of each of the aiming sectors illustrated in FIG. 21, the angular variations of the aiming band with respect to the horizontal and vertical planes of the reflector over its length are shown. As shown in FIG. 22, the angular displacement of each aiming band sector with respect to a horizontal plane varies to achieve the desired light pattern. For example, the aiming band sector which directs light to 95° from the horizontal axis (5° behind the curb line with respect to a luminaire mounted at the curb line) has an angular horizontal displacement of 93° 31' 32 " and the exit angle of the fight is 71.067°. Thus, in order to achieve the desired fight distribution pattern, each aiming band sector is specifically designed to be at a certain angle, both horizontally and vertically, with respect to the light source. It will be appreciated by those skilled in the art that the cross-sectional view comprises a series of flats associated with each aiming band joined together to form the reflector surface, even though the cross-section appears to be a curved surface.

Using flat aiming bands eliminates the probability of concentrated flux which may occur in known reflectors due to manufacturing tolerances or misalignment of the lamp within the reflector. Thus, the aiming bands of the present invention produce a' more uniform light distribution even if misalignment occurs. Furthermore, by molding the reflector geometry directly onto the inner surface of the upper housing and coating with a reflective paint or the like, reflector geometries including undercuts, such as those in the top right and top left reflector sections, are possible. Additionally, molding the reflector geometry directly in the upper housing makes it possible to generate the specific aiming angles to achieve a desired light pattern. As will be appreciated by those skilled in the art, the angular displacement of the aiming bands forming the reflector may be optimally designed to achieve a desired light distribution taking into account the size of the reflector with respect to the light source, the type of light source, the location of the light source within the reflector, the height of the fixture above the surface to be lighted and the type of light distribution pattern to be achieved.

The reflector design of the present invention also provides a thermal advantage to the light fixture. More specifically, since the reflector is formed by metallizing directly onto the interior surface of the molded composite housing, the housing acts as a heat sink to dissipate heat generated by the lamp. Accordingly, wind and outside air cool the housing to dissipate heat generated by the lamp. In conventional designs using hydroformed reflectors, there is generally an air space between the reflector and the luminaire housing. This air space acts as an insulator, similar to a double pane window, preventing heat from being dissipated and effectively trapping the heat within the luminaire housing.

Another design feature of the present invention which permits improved photometric is related to the light source being mounted at a front end of the luminaire opposite to the connection end to the pole. More specifically, the lamp, which in most instances is a high pressure gaseous discharge lamp producing the greatest amount of light at an angle perpendicular to the arc tube, is mounted in the reflector with its base (threaded screw portion) pointed to the street and tilted at angle of approximately 25° above a horizontal plane. Tilting the lamp takes advantage of the natural lumen distribution of a linear light source, such as a high pressure gaseous discharge lamp. Specifically, tilting the lamp allows more light to be directly aimed at the roadway from the lamp without having to redirect such light. Furthermore, since the socket blocks a portion of the light, by placing the socket within the house side reflector section, the light being blocked is that directed to the house side of the street which is the least important portion of reflected light coming from the luminaire. The design of the present invention places the light socket higher within the reflector cavity so that the tilted lamp makes it possible to get more light beneath the socket for redirecting to the roadway, virtually eliminating dark spots. Naturally, the tilt or angle of the lamp will be optimally chosen to allow the lamp to be as close to the opening of the reflector as possible based upon the specific shape of the lamp to be used.

Lastly, the reflector design of the present invention provides improved roadway safety. The specific reflector design including a series of aiming bands curved in the horizontal plane reflects light to be distributed at a greater angle with respect to the horizontal plane from the fixture to produce less glare and light pollution. The reflector design directs light so accurately that the need for a prismatic refractor was eliminated. Furthermore, the light distribution achieved by the luminaire of the present invention is uniformly even, with no concentrated flux or hot spots. Since the reflector design of the present invention forms a wider arch on the roadway surface than traditional fixtures, fewer fixtures are needed to light each road mile. To further optimize reflected light, the lower housing surrounding the lens in beveled to be in alignment with the reflected light so that interference therewith is kept to a minimum. The beveled cross-section also provides maximum strength to the door assembly.

Accordingly, the luminaire of the present invention is simple to install due to the two piece design, i.e., the mast mount docking station 6 and the luminaire fixture 10, which are electrically and mechanically connected via a twist-lock feature. Also, once the mast mount docking station is installed, repair and/or replacement of the luminaire is simplified and can be done "hot" since the power is connected to the luminaire by means of the mating power plugs. Furthermore, general maintenance of the luminaire has also been simplified by eliminating all unnecessary hardware, e.g. providing a plug-in photoelectric control cell, a plug-in starter, and a lower housing door latch which requires no tools to open. Additionally, the design of the lower housing which includes the ballast circuitry can easily be electrically disconnected form the upper housing by unplugging a connector and being lifted off the hooks of the upper housing for simple replacement. In the alternative, the entire luminaire can be quickly and easily replaced simply by twisting off the old luminaire and twisting on a new one. The luminaire of the present invention also provides power plugs capable of being adapted to all presently available international voltages and a fool-proof keying system to allow only corresponding voltage luminaries to be coupled to the mast mount docking station.

Various changes to the foregoing described and shown structures would now be evident to those skilled in the art. Accordingly, the particularly disclosed scope of the invention is set forth in the following claims.

What is claimed is:

1. A method of manufacturing a roadway luminaire, comprising the steps of:

molding an upper housing from a composite material, said upper housing including a dome portion such that an inner surface of the dome portion is molded having a reflector geometry, and a flange surrounding the dome portion for receiving a gasket and providing a rain lip for preventing rain from entering the dome portion, the flange further including a raceway for receiving wires of the luminaire;

applying a reflective substance directly to said inner surface of said dome portion to create a reflector;

molding a lower housing from a composite material, said lower housing supporting a lens therein; and hingedly attaching said lower housing to said upper housing, said lower housing being pivotable into an open position and latched to the upper housing in a closed position, wherein one of said upper and lower housing further includes means for mounting the luminaire to a pole.

2. The method as defined by claim 1, wherein the step of applying a reflective substance includes using a vacuum metalization process.

3. The method as defined by claim 1, wherein the step of molding the upper housing includes the step of molding first and second upper housing sections, the first section including the dome portion, and following the applying step further includes the step of mechanically coupling the first and second upper housing sections.

4. The method as defined by claim 1, wherein the step of molding thee upper housing includes the step of molding a plurality of aiming bands on the inner surface of the dome portion to form the reflector geometry.

5. The method as defined by claim 1, wherein the step of molding the upper housing includes the step of molding a plurality of undercuts on the inner surface of the dome portion to form the reflector geometry.

6. A method of manufacturing a housing for a luminaire, comprising the steps of:

molding a composite to form an upper housing including a dome section surrounding an area of a lamp and a flange surrounding the dome portion for receiving a gasket and providing a rain lip for preventing rain from entering the dome portion, the flange further including a raceway for receiving wires of the luminaire;

coating an inner surface of the dome portion with urethane;

vacuum metalizing the inner surface of the dome section with aluminum;

coating the inner surface of the dome section with acrylic thereby forming a reflective surface;

molding a lower housing from a composite material, said lower housing supporting a lens therein; and hingedly attaching said lower housing to said upper housing, said lower housing being pivotable into an open position and latched to the upper housing in a closed position, wherein one of said upper and lower housings further includes means for mounting the housing to a pole.

* * * * *